US008342861B2

(12) United States Patent
Stiehl et al.

(10) Patent No.: US 8,342,861 B2
(45) **Date of Patent: *Jan. 1, 2013**

(54) COMPACT POWER ADAPTER

(75) Inventors: Kurt Stiehl, San Jose, CA (US); Cameron Frazier, San Carlos, CA (US); Jonathan Aase, Palo Alto, CA (US); Mathias Schmidt, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/018,208

(22) Filed: Jan. 31, 2011

(65) Prior Publication Data

US 2011/0124227 A1 May 26, 2011

Related U.S. Application Data

(63) Continuation of application No. 12/480,602, filed on Jun. 8, 2009, now Pat. No. 7,896,702, which is a continuation-in-part of application No. 12/135,044, filed on Jun. 6, 2008, now Pat. No. 8,021,198.

(51) Int. Cl.
*H01R 12/00* (2006.01)

(52) U.S. Cl. ..... 439/76.1; 439/695

(58) Field of Classification Search ..... 439/76.1, 439/736, 620.22, 695

See application file for complete search history.

(56) References Cited

U.S. PATENT DOCUMENTS 1,914,944 A 6/1933 Reuben
2,030,856 A 2/1936 Dillig
2,291,837 A 8/1942 Joseph
2,537,370 A 1/1951 Parnes
2,762,026 A 9/1956 Knohl (Continued)

FOREIGN PATENT DOCUMENTS

CN 201194274 Y 6/1982

(Continued)

OTHER PUBLICATIONS

U.S. Appl. No. 12/489,429 entitled, "Compact Device Housing and Assembly Techniques Therefor", filed Jun. 23, 2009.

(Continued)

*Primary Examiner* — Neil Abrams
(74) *Attorney, Agent, or Firm* — Kilpatrick Townsend & Stockton LLP

(57) ABSTRACT

A compact power adapter is disclosed. In one embodiment, a compact power adapter is facilitated by improved approaches to construct and assemble the power adapter. According to one aspect, connectors can serve to electrically couple blades (or prongs) of a power adapter plug to a printed circuit board assembly internal to a housing for the power adapter. The connectors serve to couple AC power to the printed circuit board assembly where the AC power can be converted to DC power. The connectors also facilitate assembly of the power adapter in that reliable interconnections can be provided without wires, soldering or other custom assembly operations. In one embodiment, a base for a power adapter plug of a power adapter can include a metal base connected to a blade (or prong) of the power adapter plug. The metal base can provide mechanical support to the blade as well as electrical connectivity to an internal terminal for the power adapter plug. The internal terminals used by a power adapter plug of a power adapter can be coupled to a printed circuit board assembly using connectors, thereby facilitating interconnection with electrical components used by the power adapter.

33 Claims, 19 Drawing Sheets

U.S. PATENT DOCUMENTS

| | | | | | |
|---|---|---|---|---|---|
| 2,947,914 | A | | 8/1960 | Simons | |
| 3,315,217 | A | | 4/1967 | Bird | |
| 3,501,582 | A | * | 3/1970 | Heidler et al. | 174/532 |
| 3,636,495 | A | | 1/1972 | Forsyth, Jr. | |
| 3,878,489 | A | * | 4/1975 | Rothweiler | 335/199 |
| 4,028,654 | A | | 6/1977 | Bullard et al. | |
| 4,205,291 | A | | 5/1980 | Flentge | |
| 4,375,308 | A | | 3/1983 | Wilkinson | |
| 4,519,015 | A | | 5/1985 | Lin | |
| 4,697,863 | A | | 10/1987 | Galloway et al. | |
| 4,939,623 | A | * | 7/1990 | Equi et al. | 361/752 |
| 5,034,846 | A | * | 7/1991 | Hodge et al. | 361/119 |
| 5,046,971 | A | | 9/1991 | Ruggiero et al. | |
| 5,079,672 | A | * | 1/1992 | Haubner et al. | 361/705 |
| 5,090,911 | A | | 2/1992 | Welsh | |
| 5,106,317 | A | | 4/1992 | Taylor | |
| 5,119,204 | A | | 6/1992 | Hashimoto et al. | |
| 5,137,467 | A | | 8/1992 | Arai | |
| 5,160,879 | A | * | 11/1992 | Tortola et al. | 320/111 |
| 5,171,168 | A | | 12/1992 | Chiodo | |
| 5,175,662 | A | * | 12/1992 | DeBalko et al. | 361/119 |
| 5,178,548 | A | | 1/1993 | Fortmann et al. | |
| 5,184,285 | A | | 2/1993 | Murphy et al. | |
| 5,224,879 | A | | 7/1993 | Mullins et al. | |
| 5,242,319 | A | | 9/1993 | Ju | |
| 5,281,172 | A | | 1/1994 | Luu | |
| 5,494,449 | A | * | 2/1996 | Chioo | 439/76.1 |
| 5,540,596 | A | * | 7/1996 | Bothe et al. | 439/76.1 |
| 5,616,051 | A | | 4/1997 | Rogers | |
| 5,626,495 | A | | 5/1997 | Drewnicki | |
| 5,641,311 | A | | 6/1997 | Chuang | |
| 5,744,934 | A | * | 4/1998 | Wu | 320/111 |
| 5,755,820 | A | | 5/1998 | Lan-Jen | |
| 5,911,600 | A | | 6/1999 | Mosquera | |
| 5,928,035 | A | | 7/1999 | Jankowsky et al. | |
| 6,089,886 | A | * | 7/2000 | Mareno | 439/131 |
| 6,297,982 | B1 | | 10/2001 | Wu | |
| 6,309,225 | B2 | * | 10/2001 | Kameyama | 439/76.1 |
| 6,312,271 | B1 | | 11/2001 | Tseng | |
| 6,341,961 | B1 | | 1/2002 | Juntwait | |
| 6,471,365 | B2 | * | 10/2002 | Wang et al. | 362/84 |
| 6,478,440 | B1 | * | 11/2002 | Jaworski et al. | 362/96 |
| 6,488,540 | B2 | | 12/2002 | Coyle et al. | |
| 6,505,402 | B2 | | 1/2003 | Moriwake et al. | |
| 6,527,596 | B1 | | 3/2003 | Su | |
| 6,644,984 | B2 | | 11/2003 | Vista et al. | |
| 6,719,571 | B2 | * | 4/2004 | Koerner et al. | 439/76.1 |
| 6,846,203 | B1 | | 1/2005 | Su | |
| 6,848,918 | B2 | | 2/2005 | Chuang | |
| 6,851,955 | B2 | | 2/2005 | Chen | |
| 6,860,743 | B2 | | 3/2005 | Ekkul et al. | |
| 6,981,896 | B2 | | 1/2006 | Su | |
| 7,002,808 | B2 | * | 2/2006 | Lim et al. | 361/752 |
| 7,029,291 | B2 | | 4/2006 | Chen | |
| 7,101,226 | B1 | | 9/2006 | Gilliland | |
| 7,118,399 | B1 | * | 10/2006 | Wen et al. | 439/166 |
| 7,118,425 | B2 | | 10/2006 | Chen | |
| 7,207,809 | B2 | | 4/2007 | Sasaki et al. | |
| 7,212,420 | B2 | | 5/2007 | Liao | |
| 7,287,991 | B1 | | 10/2007 | Li | |
| 7,344,385 | B2 | | 3/2008 | Chen | |
| 7,377,802 | B2 | * | 5/2008 | Allen | 439/490 |
| 7,410,388 | B2 | * | 8/2008 | Lin | 439/501 |
| 7,499,301 | B2 | | 3/2009 | Zhou | |
| 7,563,139 | B1 | * | 7/2009 | Wang | 439/638 |
| 7,573,159 | B1 | | 8/2009 | DeIuiis et al. | |
| 7,628,621 | B2 | * | 12/2009 | Tsai | 439/131 |
| 7,658,625 | B2 | * | 2/2010 | Jubelirer et al. | 439/131 |
| 7,764,157 | B2 | * | 7/2010 | Schulz et al. | 336/198 |
| 7,789,696 | B2 | * | 9/2010 | Umei et al. | 439/447 |
| 7,794,283 | B2 | * | 9/2010 | Wang | 439/651 |
| 7,862,380 | B1 | * | 1/2011 | Wang | 439/620.22 |
| 7,896,702 | B2 | | 3/2011 | Stiehl et al. | |
| 7,983,064 | B2 | * | 7/2011 | Zhang et al. | 363/146 |
| 8,021,183 | B2 | | 9/2011 | Early et al. | |
| 8,021,198 | B2 | | 9/2011 | Lim et al. | |
| 2002/0118561 | A1 | * | 8/2002 | Katayama et al. | 363/146 |
| 2002/0154528 | A1 | * | 10/2002 | Ravid | 363/146 |
| 2003/0148665 | A1 | | 8/2003 | Su | |
| 2003/0153200 | A1 | * | 8/2003 | Vista et al. | 439/76.1 |
| 2004/0008532 | A1 | * | 1/2004 | Asawa | 363/147 |
| 2004/0075989 | A1 | | 4/2004 | Wong et al. | |
| 2004/0110397 | A1 | | 6/2004 | Chen | |
| 2004/0204177 | A1 | | 10/2004 | Pon | |
| 2006/0270250 | A1 | | 11/2006 | Allen | |
| 2009/0227122 | A1 | | 9/2009 | Jubeliver et al. | |
| 2009/0289596 | A1 | | 11/2009 | McGinley et al. | |
| 2009/0305565 | A1 | | 12/2009 | Stiehl et al. | |
| 2009/0305578 | A1 | | 12/2009 | Lim et al. | |
| 2010/0026087 | A1 | * | 2/2010 | Morita et al. | 307/3 |
| 2010/0061130 | A1 | | 3/2010 | Zhang et al. | |
| 2010/0112848 | A1 | | 5/2010 | Early et al. | |
| 2010/0159755 | A1 | | 6/2010 | Lin et al. | |

FOREIGN PATENT DOCUMENTS

| | | | |
|---|---|---|---|
| CN | 2178392 | | 9/1994 |
| CN | 2257965 | | 7/1997 |
| CN | 200963813 | Y | 10/2007 |
| CN | 101154819 | A | 4/2008 |
| CN | 201113769 | Y | 9/2008 |
| CN | 201112509 | Y | 10/2008 |
| FR | 2763182 | | 11/1998 |
| JP | 2002-149285 | | 5/2002 |
| JP | 2003-36912 | | 2/2003 |
| WO | WO 97/01199 | | 1/1997 |
| WO | WO 2008/067726 | A1 | 6/2008 |

OTHER PUBLICATIONS

Notification from Chinese Patent Office for Chinese Application Utility Model No. 200920155037.6 mailed Dec. 4, 2009.
Office Action for U.S. Appl. No. 12/135,044, mailed Jul. 8, 2009.
Office Action for U.S. Appl. No. 12/480,602, mailed Oct. 14, 2009.
Advisory Action for U.S. Appl. No. 12/135,044, mailed Jun. 2, 2010.
Final Rejection for U.S. Appl. No. 12/135,044, mailed Mar. 25, 2010.
Office Action for U.S. Appl. No. 12/135,044, mailed Jul. 8, 2010.
Final Office Action for U.S. Appl. No. 12/480,602, mailed Jun. 30, 2010.
International Search Report and Written Opinion for International Application No. PCT/US2010/035916, mailed Aug. 19, 2010.
Notice of Allowance for U.S. Appl. No. 12/480,602, mailed Nov. 1, 2010.
Final Office Action for U.S. Appl. No. 12/135,044, mailed Dec. 1, 2010.
Restriction Requirement for U.S. Appl. No. 12/363,452, mailed Feb. 5, 2010.
Office Action for U.S. Appl. No. 12/363,452, mailed Apr. 23, 2010.
Final Office Action for U.S. Appl. No. 12/363,452, mailed Sep. 10, 2010.
Office Action for U.S. Appl. No. 12/363,452, mailed Feb. 23, 2011.
Notice of Allowance for U.S. Appl. No. 12/363,452, mailed May 16, 2011.
Office Action for U.S. Appl. No. 13/195,749, mailed Oct. 24, 2011.
Search Report for Chinese Utility Model Patent ZL2010202249162, dated Dec. 15, 2011.
Office Action for U.S. Appl. No. 13/195,749, mailed Feb. 27, 2012.
Office Action for Taiwanese Utility Model Patent Application No. 099210829, mailed Mar. 9, 2011.
Communication under Rule 161 and 162 for European Patent Application No. 10732526.8 mailed Feb. 13, 2012.
U.S. Appl. No. 12/135,044 entitled, "Low-Profile Power Adapter", filed Jun. 6, 2008.
U.S. Appl. No. 12/480,602 entitled, "Compact Power Adapter", filed Jun. 8, 2009.
Office Action for Taiwanese Utility Model Patent Application No. 099210829, mailed Nov. 12, 2010.
Notice of Allowance for U.S. Appl. No. 12/135,044, mailed Apr. 19, 2011.

* cited by examiner

COMPACT POWER ADAPTER

CROSS-REFERENCE TO RELATED APPLICATIONS

This application is a continuation application of U.S. patent application Ser. No. 12/480,602, filed Jun. 8, 2009, entitled "LOW-PROFILE POWER ADAPTER" (now U.S. Pat. No. 7,896,702), which is hereby incorporated herein by reference, and which is a continuation-in-part application of U.S. patent application Ser. No. 12/135,044, filed Jun. 6, 2008, entitled "LOW-PROFILE POWER ADAPTER", (now U.S. Pat. No. 8,021,198), which is hereby incorporated herein by reference.

BACKGROUND OF THE INVENTION

1. Field of the Invention

The present invention relates to power adapters for electronic devices.

2. Description of the Related Art

There exists today may different portable electronic devices that are powered by rechargeable batteries. Examples of such portable electronic devices include mobile phones, portable media players, personal digital assistants (PDAs), etc. To facilitate recharging of the rechargeable batteries, a portable electronic device is normally sold with a power adapter. Typically, the power adapter has a power plug for coupling to an AC outlet. The power plug is a significant part of a power adapter that is required to meet certain specifications for safety reasons. The power adapter also contains electronic circuitry that converts AC power acquired from the AC outlet into DC power and outputs DC power via a cord having a connector. The connector of the cord connects to the portable electronic device and allows the DC power to be received at the portable electronic device so as to power the portable electronic device and/or charge the rechargeable battery. There is, however, an ongoing demand for small and thinner power adapters. Accordingly, there is a need to provide improved power adapters are efficient in their construction and operation.

SUMMARY

The invention relates to compact power adapters. In one embodiment, a compact power adapter is facilitated by improved approaches to construct and assemble the power adapter. According to one aspect, connectors can serve to electrically couple blades (or prongs) of a power adapter plug to a printed circuit board assembly internal to a housing for the power adapter. The connectors serve to couple AC power to the printed circuit board assembly where the AC power can be converted to DC power. The connectors also facilitate assembly of the power adapter in that reliable interconnections can be provided without wires, soldering or other custom assembly operations. In one embodiment, a base for a power adapter plug of a power adapter can include a metal base connected to a blade (or prong) of the power adapter plug. The metal base can provide mechanical support to the blade as well as electrical connectivity to an internal terminal for the power adapter plug. The internal terminals used by a power adapter plug of a power adapter can be coupled to a printed circuit board assembly using connectors, thereby facilitating interconnection with electrical components used by the power adapter.

The invention may be implemented in numerous ways, including, but not limited to, as a system, device, or apparatus, or method. Example embodiments of the present invention are discussed below.

As a portable power adapter for a portable electronic device, one embodiment of the invention can, for example, include at least: a cap; at least one metal member extending through the cap; a housing having a body with an opening configured to receive the cap; a printed circuit board assembly having a plurality of electrical components coupled thereto can be provided in the housing; and at least one connector mounted on the printed circuit board assembly. The at least one connector can be configured to electrically connect the at least one metal member to the printed circuit board when the cap is attached to the housing.

As an electronic device, one embodiment of the invention can, for example, include at least: a housing having a plurality of external blades and at least one opening; an electrical connector accessible from the opening in the housing; and a printed circuit board assembly having a plurality of electrical components coupled thereto. The printed circuit board assembly can be provided within the housing and can be electrically connected to the electrical connector. The printed circuit board assembly can include a plurality of connector receptacles arranged to receive conductive members internal to the housing that electrically correspond to the external blades. The conductive members can be positionally offset from the external blades.

As a power adapter, one embodiment of the invention can, for example, include at least: a first metal prong having a front end and a back end; a first metal base mechanically and electrically connected to the back end of the first metal prong, the first metal base including or coupling to at least a first connection member; a second metal prong having a front end and a back end; a second metal base mechanically and electrically connected to the back end of the second metal prong, the second metal base including or coupling to at least a second connection member; a molded cap formed around the first and second metal bases such that the first and second metal prongs are at least partially exposed and the first and second metal bases are not exposed except for the first and second connection members which are at least partially exposed, the molded base being non-conductive; a housing having a body with an opening configured to receive the molded cap; and a printed circuit board assembly having a plurality of electrical components coupled thereto, the printed circuit board assembly being provided within the housing. When the molded cap is attached to the housing, the first metal prong is electrically connected to the printed circuit board assembly via first connection member, and the second metal prong is electrically connected to the printed circuit board assembly via second connection member.

As a power adapter, another embodiment of the invention can, for example, include at least: a first metal member including a first metal prong and a first connection member; a second metal member including a second metal prong and a second connection member; a molded cap formed around the first and second metal members such that the first and second metal prongs are at least partially exposed and the first and second connection members are at least partially exposed, the molded base being non-conductive; a housing having a body with an opening configured to receive the molded cap; a printed circuit board assembly having a plurality of electrical components coupled thereto, the printed circuit board assembly being provided within the housing; a first connector mounted on the printed circuit board assembly, the first connector being configured to receive the first connection member when the molded cap is attached to the housing, thereby electrically connecting the first connection member, and thus the first metal prong, to the printed circuit board assembly; and a second connector mounted on the printed circuit board assembly, the second connector being configured to receive the second connection member when the molded cap is attached to the housing, thereby electrically connecting the second connection member, and thus the second metal prong, to the printed circuit board assembly.

As a method for assembling a power adapter, one embodiment of the invention can, for example, include at least: obtaining a printed circuit board assembly having first and second electrical connectors and a plurality of electrical components mounted thereon; obtaining a housing for the power adapter, the housing including at least one opening for receiving the printed circuit board assembly; inserting the printed circuit board assembly into the housing via the at least one opening in the housing, wherein once the printed circuit board assembly is inserted into the housing, the first and second electrical connectors remain accessible via the opening in the housing; securing the printed circuit board assembly within the housing; and attaching a cap having first and second exposed inner contact members to the opening in the housing, wherein once the cap is attached to the opening in the housing, the first and second exposed inner contact member respectively electrically connect with the first and second electrical connectors.

Various aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF EMBODIMENTS OF THE INVENTION

The invention relates to compact power adapters. In one embodiment, a compact power adapter is facilitated by improved approaches to construct and assemble the power adapter. According to one aspect, connectors can serve to electrically couple blades (or prongs) of a power adapter plug to a printed circuit board assembly internal to a housing for the power adapter. The connectors serve to couple AC power to the printed circuit board assembly where the AC power can be converted to DC power. The connectors also facilitate assembly of the power adapter in that reliable interconnections can be provided without wires, soldering or other custom assembly operations. In one embodiment, a base for a power adapter plug of a power adapter can include a metal base connected to a blade (or prong) of the power adapter plug. The metal base can provide mechanical support to the blade as well as electrical connectivity to an internal terminal for the power adapter plug. The internal terminals used by a power adapter plug of a power adapter can be coupled to a printed circuit board assembly using connectors, thereby facilitating interconnection with electrical components used by the power adapter.

Exemplary embodiments of the present invention are discussed below with reference to the various figures. However, those skilled in the art will readily appreciate that the detailed description given herein with respect to these figures is for explanatory purposes, as the invention extends beyond these embodiments.

Figure 1A:
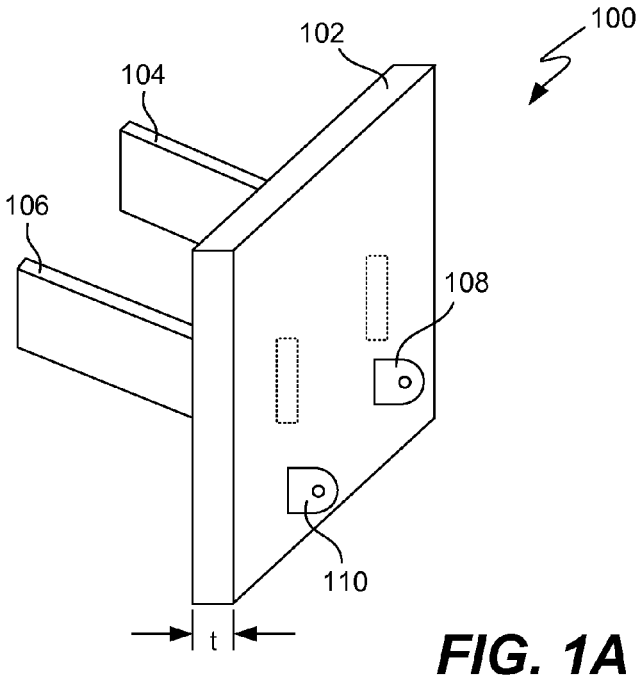
FIG. 1A is a perspective view of a power adapter plug according to one embodiment of the invention.

FIG. 1A is a perspective view of a power adapter plug 100 according to one embodiment of the invention. The power adapter plug 100 includes a base 102, a first blade 104 and a second blade 106. In addition, the power adapter plug 100 includes a first terminal 108 and a second terminal 110. The base 102 is typically formed from a non-conductive material, such as plastic, and serves to support the first blade 104 and the second blade 106. The blades 104 and 106 extend outward from a first side (e.g., front side) of the base 102. The terminals 108 and 110 extend outward from a second side (e.g., back side) of the base 102. Although the blades 104 and 106 have a rectangular cross-section, the blades 104 and 106 can have other cross-sectional shapes. Hence, more generally, the blades are referred to as prongs herein.

The terminals 108 and 110 can be placed at any location on the second side of the base 102. In other words, in the terminals 108 and 110 do not have to be positioned directly behind the corresponding blades 104 and 106 as would be the case with conventional approaches. Instead, the terminals 108 and 110 can be offset from the positions of the blades 104 and 106, such that the terminals 108 and 110 can be positioned anywhere on the second side of the base 102. By controlling the position of the terminals 108 and 110, assembly of the power adapter 102 with other electrical components, such as a printed circuit board, can be performed in a space efficient manner. For example, the power adapter plug 100 can be directly attached to a printed circuit board since the position of the terminals 108 and 110 can be designed so as to correspond to connection terminals of the printed circuit board.

In one embodiment, advantageously, the thickness t of the base 102 is thin. The thickness t of the base 102 is, for example, less than about 0.5-3.0 millimeters. In one specific example the thickness t of the base 102 can be about 2.5 millimeters. As a result, the power adapter plug 100 can be considered a low-profile power adapter.

Figure 1B:
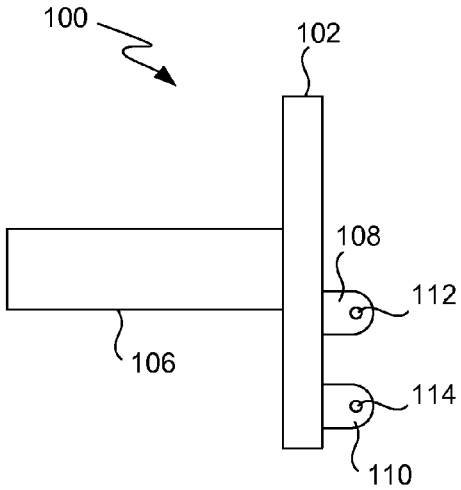
FIG. 1B illustrates a side view of the power adapter plug according to the embodiment illustrated in FIG. 1A.

FIG. 1B illustrates a side view of the power adapter plug 100 according to the embodiment illustrated in FIG. 1A. As illustrated in FIG. 1B, the terminals 108 and 110 of the power adapter plug 100 are repositioned to a lower portion of the base 102. In addition, to facilitate electrical connection (e.g., solder connection) with respect to other electrical components, such as a printed circuit board, the first terminal 108 can include an opening 112 and the second terminal 110 can include an opening 114.

Figure 1C:
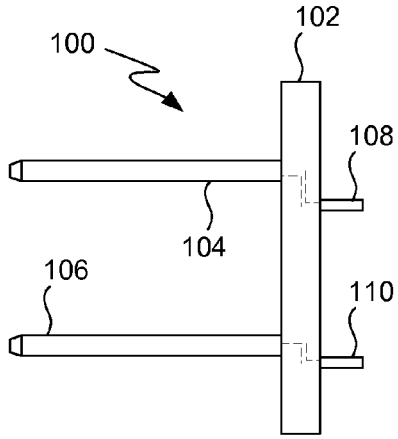
FIG. 1C illustrates a top view of the power adapter plug according to the embodiment illustrated in FIG. 1A.

FIG. 1C illustrates a top view of the power adapter plug 100 according to the embodiment illustrated in FIG. 1A. The power adapter plug 100 illustrated in FIG. 1C shows that the terminals 108 and 110 have been be positioned (i.e., offset) toward one side of the base 102.

Figure 2:
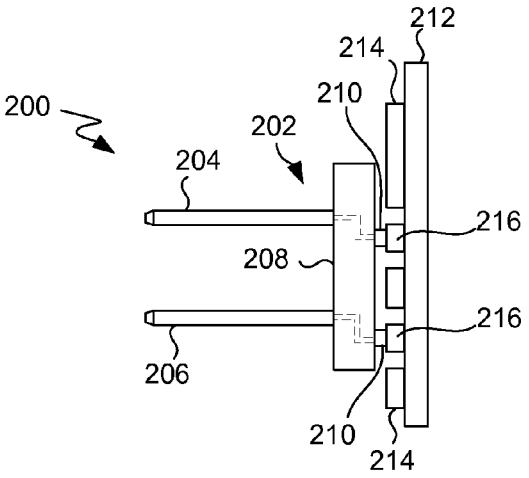
FIG. 2 is a side view of an electronic device assembly according to one embodiment of the invention.

FIG. 2 is a side view of an electronic device assembly 200 according to one embodiment of the invention. The electronic device assembly 200 is for a power adapter, such as a power adapter that connects to an AC outlet and produces a DC output for powering an electronic device and/or charging a rechargeable battery of the electronic device.

The electronic device assembly 200 includes a power adapter plug 202. The power adapter plug 202 can, for example, be constructed similar to the power adapter plug 100 illustrated in FIGS. 1A-1C. The power adapter plug 202 includes a first blade 204, a second blade 206, and a base 208. The base 208 supports the first blade 204 and the second blade 206. The base 208 also supports terminals 210. The electronic device assembly 200 also includes a printed circuit board 212. The power adapter plug 202 can be mechanically and electrically connected to the printed circuit board 212. The printed circuit board 212 includes a plurality of electrical components 214 attached onto at least one side of the printed circuit board 212 to provide various electrical operations. The terminals 210 of the base 208 of the power adapter plug 202 can be utilized to couple to corresponding connection points 216 of the printed circuit board 212. Accordingly, in one embodiment, the terminals 210 of the power adapter plug 202 can be mechanically and electrically connected to corresponding ones of the connection points 216 of the printed circuit board 212. These connections, for example, can be formed by soldering the terminals 210 (directly or indirectly) to the corresponding connection points 216. As another example, connectors can be used to provide mechanical and/or electrical connection of the power adapter plug 202 and the printed circuit board 212.

In one embodiment, the power adapter plug 202 is a low-profile adapter plug which is able to couple directly to the printed circuit board 212 without intervening mechanical assistance by other components. As a result, the overall thickness of an electronic device (e.g., power adapter) being formed to enclose the electronic device assembly 200 can be smaller and thinner. As shown in FIG. 2, the base 208 of the power adapter plug 200 is positioned adjacent the electrical components 214 mounted on the printed circuit board 212. However, in another embodiment, the base 208 of the power adapter plug 200 can be positioned immediately adjacent the printed circuit board 212 (without any intervening electrical components 214).

Once the power adapter plug 202 is electrically (and possibly mechanically) connected to the printed circuit board 212, the power adapter assembly 200 can be enclosed within an external device housing (not shown), thereby forming a power adapter product. In operation, the power adapter assembly 200 can serve to convert AC power into DC power, and then supply the DC power to electrical components of an electronic device which can be electrically connected to the power adapter assembly 200 directly (e.g., integral with electronic device) or indirectly (e.g., by connector and/or wire (cord). For example, the blades 204 and 206 of the power adapter assembly 200 can be inserted into an AC electrical outlet from which high-voltage alternating current can be acquired. The electrical components 214 associated with the printed circuit board 212 can operate to convert the high-voltage Alternating Current (AC) into a low-voltage Direct Current (DC) which is suitable for use for powering electrical components of the electronic device.

Although the power adapter assembly 200 illustrated in FIG. 2 includes a printed circuit board 212, in other embodiments, the printed circuit board 212 can be replaced with a different substrate. For example, the substrate can alternatively be a flexible substrate (e.g., flex-circuit).

Figure 3:
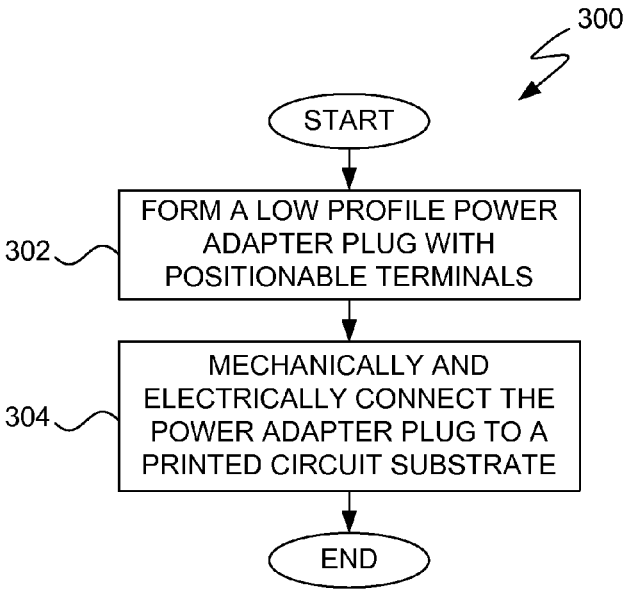
FIG. 3 is a flow diagram of an electronic device assembly process according to one embodiment of the invention.

FIG. 3 is a flow diagram of an electronic device assembly process 300 according to one embodiment of the invention. The electronic device assembly process 300 can, for example, correspond to a process utilized to assemble the electronic device assembly 200 illustrated in FIG. 2.

The electronic device assembly process 300 can initially form 302 a low-profile power adapter plug with positionable terminals. As an example, the low-profile power adapter plug can correspond to the power adapter plug 100 illustrated in FIGS. 1A-1C or the power adapter plug 202 illustrated in FIG. 2. After the low-profile power adapter plug has been formed 302, the power adapter plug can be mechanically and electrically connected 304 to a printed circuit substrate. The printed circuit substrate can, for example, pertained to a printed circuit board. However, in other embodiments, the printed circuit substrate can correspond to a flexible printed circuit substrate, such as a flex-circuit.

As noted above terminals on a base of a power adapter can be positioned (or repositioned) to a more desirable location. In other words, the terminals can be positioned anywhere on a base of the power adapter. There are various embodiments for positioning the terminals. In one embodiment, a terminal can result from a portion of a metal base that is provided internal the base of the power adapter plug. In another embodiment, one or more connection members can link a metal base to a terminal location.

Figure 4A:
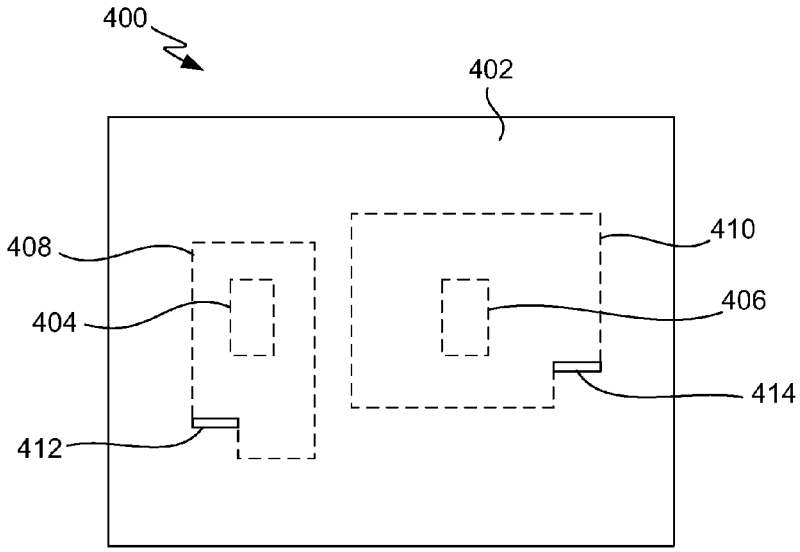
FIG. 4A is a back view of a power adapter plug according to one embodiment of the invention.

FIG. 4A is a back view of a power adapter plug 400 according to one embodiment of the invention. The power adapter plug 400 can, for example, correspond to the power adapter plug 100 illustrated in FIGS. 1A-1C or the power adapter plug 202 illustrated in FIG. 2. The back view illustrated in FIG. 4A illustrates a back side of a base 402 of the power adapter plug 400. The base 402 can, for example, be performed by an injection molding. The corresponding front side (not shown) of the base 402 has a pair of blades 404 and 406 extending therefrom. More generally, the blades 404 and 406 can be referred to as prongs. Internal to the base 402 is a first base plate 408 and a second base plate 410. Although dependent on implementation, in one embodiment, the first base plate 408 and the second base plates 410 are thin metal plates, such as stainless steel with a thickness of about 0.1-0.5 millimeters.

The first base plate 408 is coupled to a rear end of the blade 404. The first base plate 408 serves as a structural base for the blade 404. In one implementation, the first base plate 408 is mechanically connected to the blade 404. The mechanical connection can, for example, be provided by (i) interlocking the blade 404 with the first base plate 408, (ii) soldering the parts together, and/or (iii) using some attachment members (such as screws, fasteners or rivets). In addition to providing mechanical connection, once the first base plate 408 is connected to the blade 404, the blade 404 and the first base plate 408 are also electrically connected.

Similarly, the second base plate 410 is coupled to a rear end of the blade 406. The second base plate 410 serves as a structural base for the blade 406. In one implementation, the second base plate 410 is mechanically connected to the blade 406. The mechanical connection can, for example, be provided by (i) interlocking the blade 406 with the second base plate 410, (ii) soldering the parts together, and/or (iii) using some attachment members (such as screws, fasteners or rivets). In addition to providing mechanical connection, once the second base plate 410 is connected to the blade 406, the blade 406 and the second base plate 410 are also electrically connected.

The first base plate 408 and the second base plate 410 can also respectively serve to support a first terminal 412 and a second terminal 414. The terminals 412 and 414 are at least partially exposed and thus accessible on the back side of the base 402. The terminals 412 and 414 serve as internal connection points for the power adapter plug 400. Hence, the terminals 412 and 414 can also be referred to as internal terminals. The utilization of the base plates 408 and 410 operates to facilitate the placement of the terminals 412 and 414 anywhere along the back side of the base 402. Consequently, the interconnection of the power adapter plug 400 with respect to other electrical circuitry or components is greatly facilitated.

Figure 4B:
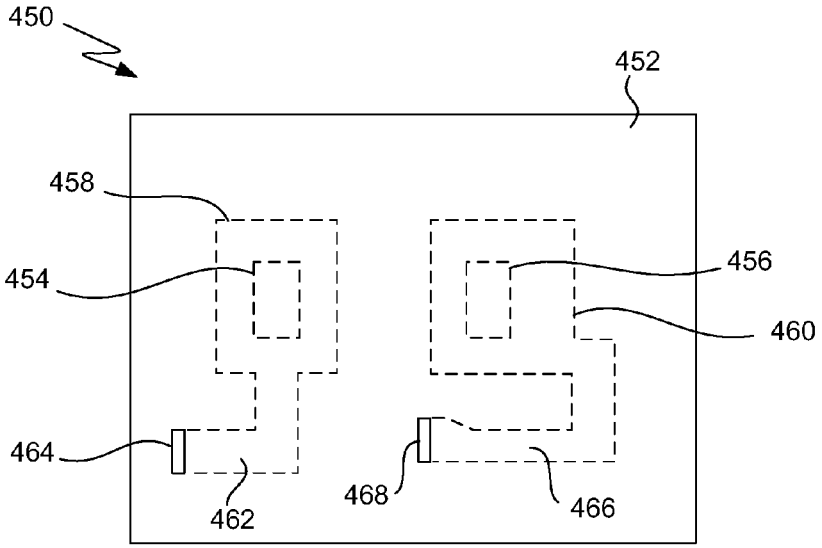
FIG. 4B is a back view of a power adapter plug according to another embodiment of the invention.

FIG. 4B is a back view of a power adapter plug 450 according to another embodiment of the invention. The power adapter plug 450 can, for example, correspond to the power adapter plug 100 illustrated in FIGS. 1A-1C or the power adapter plug 202 illustrated in FIG. 2. The back view illustrated in FIG. 4B illustrates a back side of a base 452 of the power adapter plug 450. The base 452 can, for example, be performed by an injection molding. The corresponding front side (not shown) of the base 452 has a pair of blades 454 and 456 extending therefrom. More generally, the blades 454 and 456 can be referred to as prongs. Internal to the base 452 is a first base plate 458 and a second base plate 460. In one embodiment, the first base plate 458 and the second base plates 460 are thin metal plates, such as stainless steel with a thickness of about 0.1-0.5 millimeters.

The first base plate 458 is coupled to a rear end of the blade 454. The first base plate 458 serves as a structural base for the blade 454. In one implementation, the first base plate 458 is mechanically connected to the blade 454. The mechanical connection can, for example, be provided by (i) interlocking the blade 454 with the first base plate 458, (ii) soldering the parts together, and/or (iii) using some attachment members (such as screws, fasteners or rivets). In addition to providing mechanical connection, once the first base plate 458 is connected to the blade 454, the blade 454 and the first base plate 458 are also electrically connected. In addition, the base 452 can further include a first connection member 462 that provides a path within the base 452 from the first base plate 458 to a first terminal 464. The first terminal 464 is electrically connected to the first base plate 458 via the first connection member 462. The first terminal 464 is at least partially exposed and thus accessible on the back side of the base 452. The first connection member 462 can be integrally formed with the first base plate 458. Alternatively, the first connection member 462 can be separately formed and subsequently connected to the first base plate 458. The first connection member 462 thus permits the first terminal 464 to be positioned (and oriented) in any position along the back side of the base 452.

Similarly, the second base plate 460 is coupled to a rear end of the blade 456. The second base plate 460 serves as a structural base for the blade 456. In one implementation, the second base plate 460 is mechanically connected to the blade 456. The mechanical connection can, for example, be provided by (i) interlocking the blade 456 with the second base plate 460, (ii) soldering the parts together, and/or (iii) using some attachment members (such as screws, fasteners or rivets). In addition to providing mechanical connection, once the second base plate 460 is connected to the blade 456, the blade 456 and the second base plate 460 are also electrically connected. In addition, the base 452 can further include a second connection member 466 that provides a path within the base 452 from the second base plate 460 to a second terminal 468. The second terminal 468 is electrically connected to the second base plate 460 via the second connection member 466. The second terminal 468 is at least partially exposed and thus accessible on the back side of the base 452. The second connection member 466 can be integrally formed with the second base plate 460. Alternatively, the second connection member 466 can be separately formed and subsequently connected to the second base plate 460. The second connection member 466 thus permits the second terminal 468 to be positioned (and oriented) in any position along the back side of the base 452.

The terminals 464 and 468 serve as internal connection points for the power adapter plug 450. Hence, the terminals 464 and 468 can also be referred to as internal terminals. The utilization of the base plates 458 and 460 together with the respective connection members 462 and 466 facilitates the placement of the terminals 464 and 468 anywhere along the back side of the base 452. Consequently, the interconnection of the power adapter plug 450 with respect to other electrical circuitry or components is greatly facilitated.

Figure 4C:
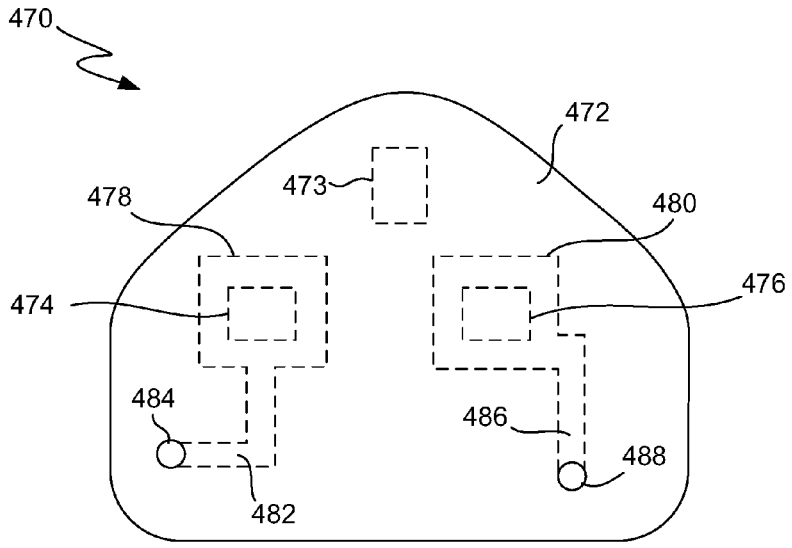
FIG. 4C is a back view of a power adapter plug according to still another embodiment of the invention.

FIG. 4C is a back view of a power adapter plug 470 according to still another embodiment of the invention. The power adapter plug 470 is generally similar to the power adapter plug 450 illustrated in FIG. 4B. However, the power adapter plug 470 has a European plug configuration. The back view illustrated in FIG. 4C illustrates a back side of a base 472 of the power adapter plug 470. The base 472 can, for example, be performed by an injection molding. The corresponding front side (not shown) of the base 472 has a front prong 473 and a pair of rear prongs 474 and 476 extending therefrom. Internal to the base 472 is a first base plate 478 and a second base plate 480. In one embodiment, the first base plate 478 and the second base plates 480 are thin metal plates, such as stainless steel with a thickness of about 0.1-0.5 millimeters.

The first base plate 478 is coupled to a rear end of the prong 474. The first base plate 478 serves as a structural base for the prong 474. In one implementation, the first base plate 478 is mechanically connected to the prong 474. The mechanical connection can, for example, be provided by (i) interlocking the prong 474 with the first base plate 478, (ii) soldering the parts together, and/or (iii) using some attachment members (such as screws, fasteners or rivets). In addition to providing mechanical connection, once the first base plate 478 is connected to the prong 474, the prong 474 and the first base plate 478 are also electrically connected. In addition, the base 472 can further include a first connection member 482 that provides a path within the base 472 from the first base plate 478 to a first connector 484 (e.g., pin or post type connector), which serves as a first terminal. The first connector 484 is electrically connected to the first base plate 478 via the first connection member 482. The first connector 484 is at least partially exposed and thus accessible on the back side of the base 472. The first connection member 482 can be integrally formed with the first base plate 478. Alternatively, the first connection member 482 can be separately formed and subsequently connected to the first base plate 478. The first connection member 482 thus permits the first connector 484 to be positioned (and oriented) in any position along the back side of the base 472.

Similarly, the second base plate 480 is coupled to a rear end of the prong 476. The second base plate 480 serves as a structural base for the prong 476. In one implementation, the second base plate 460 is mechanically connected to the prong 476. The mechanical connection can, for example, be provided by (i) interlocking the prong 476 with the second base plate 480, (ii) soldering the parts together, and/or (iii) using some attachment members (such as screws, fasteners or rivets). In addition to providing mechanical connection, once the second base plate 480 is connected to the prong 476, the prong 476 and the second base plate 480 are also electrically connected. In addition, the base 472 can further include a second connection member 486 that provides a path within the base 472 from the second base plate 480 to a second connector 488 (e.g., pin or post type connector), which serves as a second terminal. The second connector 488 is electrically connected to the second base plate 480 via the second connection member 486. The second connector 488 is at least partially exposed and thus accessible on the back side of the base 472. The second connection member 486 can be integrally formed with the second base plate 480. Alternatively, the second connection member 486 can be separately formed and subsequently connected to the second base plate 480. The second connection member 486 thus permits the second terminal 488 to be positioned (and oriented) in any position along the back side of the base 472.

The connectors 484 and 488 serve as internal connection points for the power adapter plug 470. Hence, the connectors 484 and 488 can also be referred to as internal terminals. The utilization of the base plates 478 and 480 together with the respective connection members 482 and 486 facilitates the placement of the terminals 484 and 488 anywhere along the back side of the base 472. Consequently, the interconnection of the power adapter 470 with respect to other electrical circuitry or components is greatly facilitated.

The blades (or probes) and base plates utilized in accordance with the invention can take may different sizes and configurations. The blades can also attach to the base plates in various different ways.

Figure 5A:
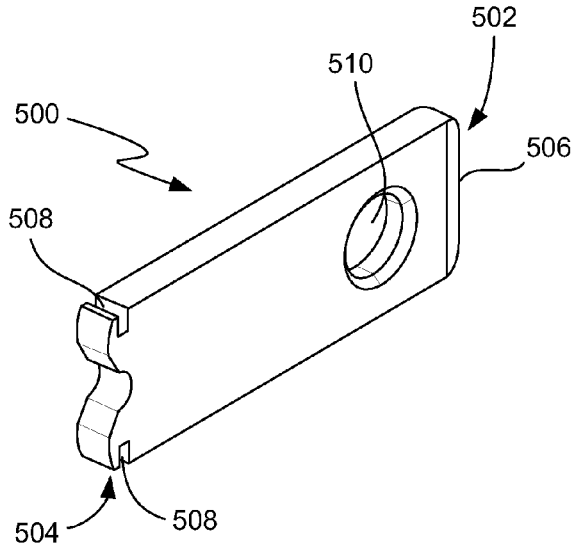
FIG. 5A illustrates an exemplary blade according to one embodiment of the invention.

FIG. 5A illustrates an exemplary blade 500 according to one embodiment of the invention. The blade 500 has a front end 502 and a back end 504. The front end 502 can be a rounded or tapered. The back end 504 can include attachment features, which in this embodiment includes notches 508. The attachment features are used to attach the blade 500 to a base plate. The blade 500 can also have an opening 510 proximate to the front end 502.

Figure 5B:
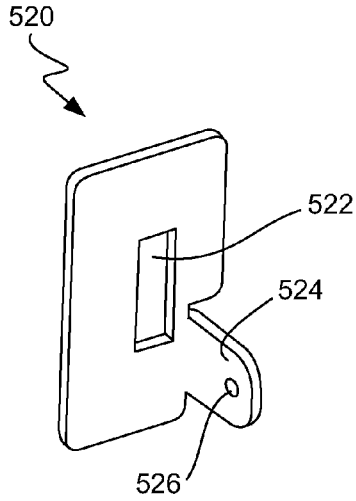
FIG. 5B illustrates an exemplary base plate according to one embodiment of the invention.

FIG. 5B illustrates an exemplary base plate 520 according to one embodiment of the invention. The base plate 520 is typically a thin metal sheet of metal, such as stainless steel. For example, the thickness of the base plate 520 can be about 1-5 millimeters. The base plate 520 has an opening 522 for receiving a blade, such as the blade 500. The base plate 520 also include a terminal 524 which can have a small opening 526. The terminal 524 can be formed by bending a portion of the base plate 520. For example, the terminal can be formed by bending the portion of the base plate 520 normal to the surface of the base plate 520. The opening 526 facilitates electrical connection to the terminal 524.

Figure 5C:
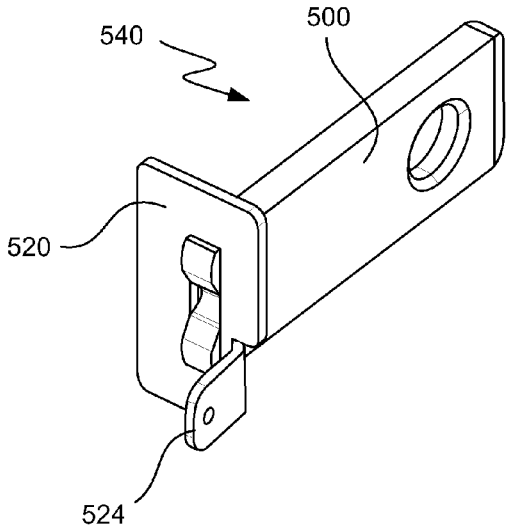
FIG. 5C illustrates an assembly of the blade illustrated in FIG. 5A and the base plate illustrated in FIG. 5B.

FIG. 5C illustrates an assembly of the blade 500 illustrated in FIG. 5A and the base plate 520 illustrated in FIG. 5B. The base plate 520 can be affixed to the blade 500 using the attachment features. Namely, the edge of the opening 522 of the base plate 520 can be received in the notches 508 of the blade 500, thereby securing the blade 500 to the base plate 520. In some cases, the attachment features can be mechanically altered (e.g., press-fit) to secure the attachment of the blade 500 to the base plate 520.

The blades (or prongs) used with the power adapter plug are metal. For example, the blades can be stainless steel or cooper. The formation of the blades can done using an extruding or stamping techniques. Stamping tends to leave shear marks which can be undesirable. Hence, it may be preferred to extrude the blades since the surface quality of the edges of the blades can clean, smooth and without shear marks. In one embodiment, the blades can be formed by extruding a metal bar having a width as desired for the height of the blades. Then, individual blades can be separated (or singulated) from the metal bar using a stamping process. Since the stamping of the metal bar does not stamp the sides of the blades (since the width is accurately set by the extruded bar), the surface quality of the sides of the blades is excellent. The exposed end (i.e., exposed tip) of the blades can usually thereafter be smoothed or rounded by a polishing or grinding step so that insertion into an AC outlet facilitated.

Figure 5D:
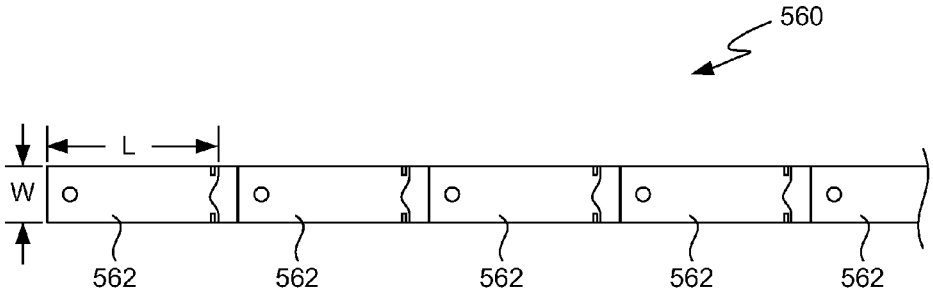
FIG. 5D illustrates an exemplary metal bar according to one embodiment of the invention.

FIG. 5D illustrates an exemplary metal bar 560 according to one embodiment of the invention. The metal bar 560 is an extruded metal bar of metal, such as sheet metal, from which a plurality of blades 562 for plugs (e.g., for power adapters) can be formed. The metal bar 560 has a width W that represents the width of the blades. Individual ones of the blades 562 having a length L can be stamped or cut from the metal bar 560. Since the metal bar 560 is extruded at the width W, the surface quality along the length L of the sides of the blades 562 is excellent. For example, there are no shear marks along the length of the blades.

Figure 6:
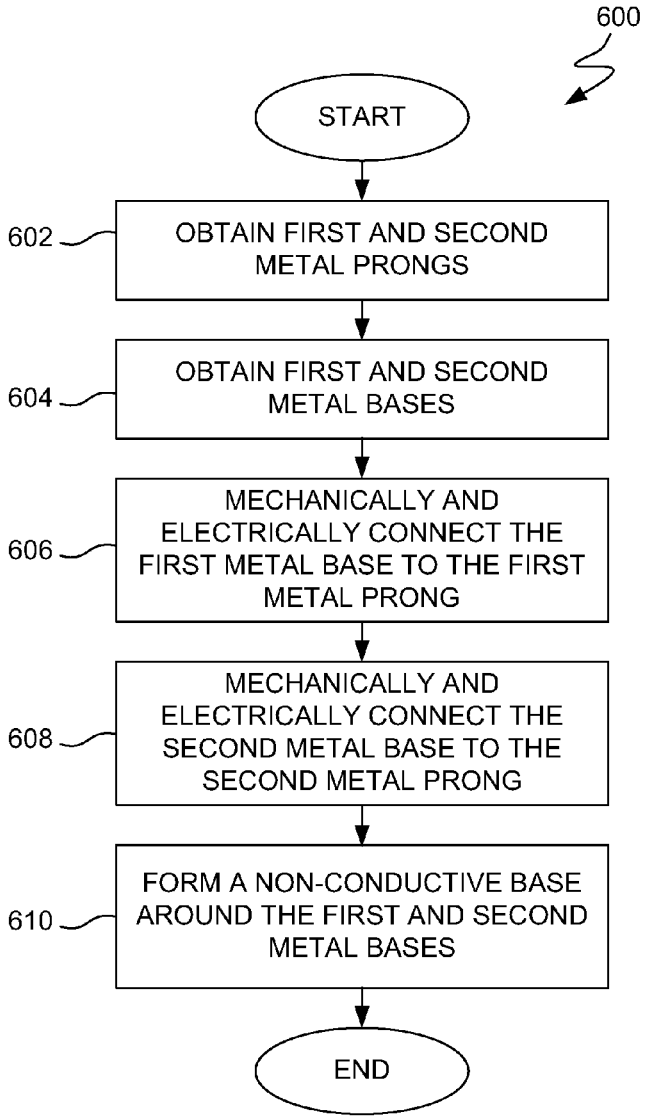
FIG. 6 is a flow diagram of a power adapter assembly process according to one embodiment of the invention.

FIG. 6 is a flow diagram of a power adapter assembly process 600 according to one embodiment of the invention. The power adapter assembly process 600 pertains to assembly or construction of a power adapter plug that is part of a power adapter. The power adapter assembly process 600 obtains 602 first and second metal prongs. In addition, first and second metal bases can be obtained 604. Next, the first metal base can be mechanically and electrically connected 606 to the first metal prong. Similarly, the second metal base can be mechanically and electrically connected 608 to the second metal prong. Thereafter, a non-conductive base can be formed 610 around the first and second metal bases. Following the block 610, the power adapter assembly process 600 can end.

In one implementation, the non-conductive base is formed 610 using an injection molding process. The utilization of the metal bases to mechanically support and electrically connect with the metal prongs allows the thickness of the non-conductive base to be relatively thin. In other words, the non-conductive base can be formed with a minimized thickness which facilitates smaller and more compact power adapter designs.

Figure 7:
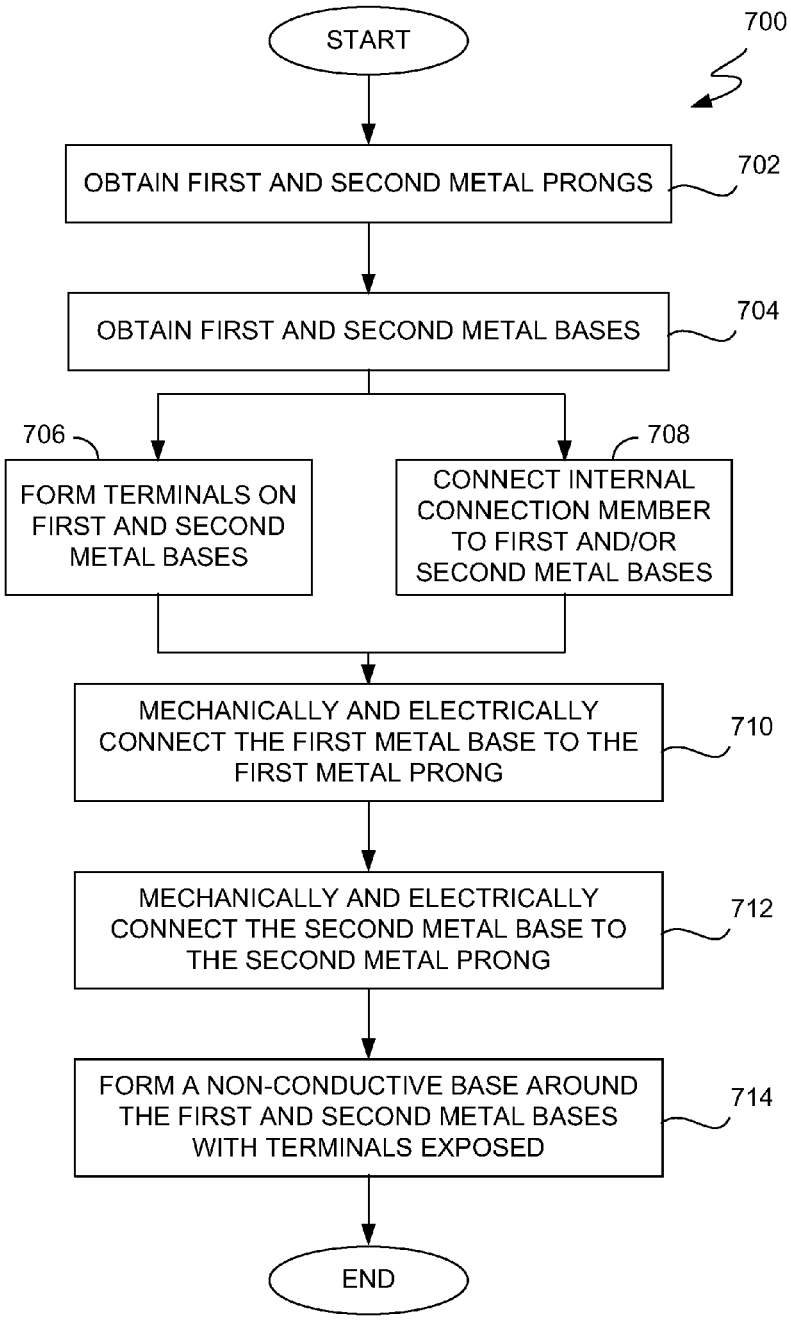
FIG. 7 is flow diagram of a power adapter assembly process according to one embodiment of the invention.

FIG. 7 is flow diagram of a power adapter assembly process 700 according to one embodiment of the invention. The power adapter assembly process 700 pertains to assembly or construction of a power adapter plug that is part of a power adapter. The power adapter assembly process 700 can obtain 702 first and second metal prongs. In addition, first and second metal bases can be obtained 704. Then, depending upon implementation, the internal terminals that are to be provided on the resulting power adapter plug can be a formed from either a portion of the metal bases or from connection members with or without use of additional parts (such as pin or post connectors). In one implementation, terminals can be formed 706 on the first and second metal bases. As an example, a portion of the first and second metal bases can be designed to be bent on assembly. Then, during assembly, the bendable portion of the metal bases can be bent into position so as to form a respective terminal. In another implementation, one or more internal connection members can be connected 708 to the first and/or second metal bases. The internal connection members can facilitate repositioning of the resulting terminals with respect to the non-conductive base of the power adapter plug. For example, one end of a connection member can be mechanically and electrically connected to the metal base and then the other end of the internal connection member can be provided with a pin or post connector that is to serve as the terminal.

In any case, following the block 706 or the block 708, the power adapter assembly process 700 can mechanically and electrically connect 710 the first metal base to the first metal prong. Similarly, the second metal base can be mechanically and electrically connected 712 to the second metal prong. Thereafter, a non-conductive base can be formed at 714 around the first and second metal bases. The non-conductive base that is formed 714 has the terminals at least partially exposed on the surface of the non-conductive base.

Additionally, after constructing the power adapter plug in accordance with the power adapter assembly process 600 illustrated in FIG. 6 or the power adapter assembly process 700 illustrated in FIG. 7, further assembly can be performed. In one embodiment, the power adapter plug can then be coupled to a printed substrate (e.g., PCB, flex-circuit) containing electrical components for adapting AC power to suitable DC power. Thereafter, if the power adapter is a standalone product, a housing can be placed around the assembly of the power adapter plug and the printed substrate.

Figure 8:
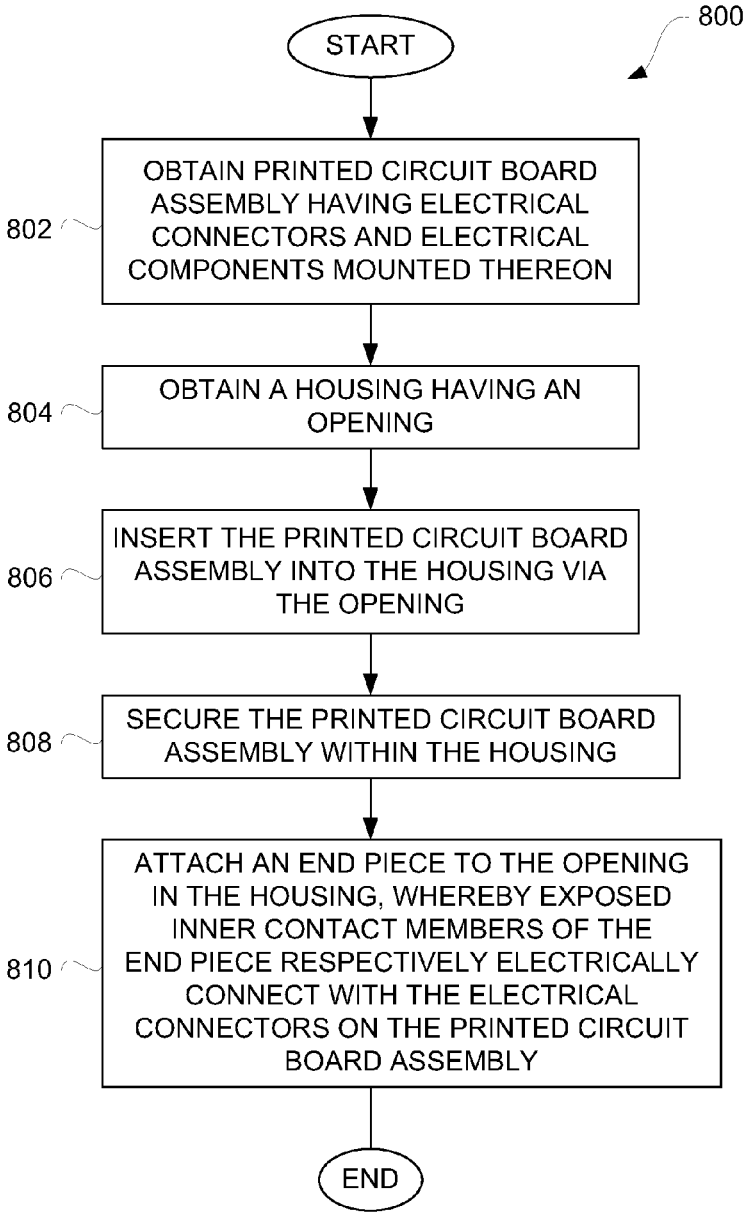
FIG. 8 is flow diagram of a power adapter assembly process according to one embodiment of the invention.

FIG. 8 is flow diagram of a power adapter assembly process 800 according to one embodiment of the invention. The power adapter assembly process 800 pertains to assembly or construction of a power adapter product.

The power adapter assembly process 800 can obtain 802 a printed circuit board assembly. The printed circuit board assembly includes electrical connectors and electrical components mounted thereon. A housing having an opening is also obtained 804. The housing serves as the external surface for the power adapter product. Next, the printed circuit board assembly can be inserted 806 into the housing via the opening. In one embodiment, the housing can provide a single opening through which articles to be included within the housing can be inserted. Namely, the printed circuit board assembly can be inserted 806 into the housing through the opening. Additionally, the printed circuit board assembly can then be secured 808 within the housing. The printed circuit board assembly can be secured within the housing in a variety of different ways. For example, the printed circuit board assembly can be secured 808 by an adhesive, such as glue. Alternatively, as another example, the printed circuit board assembly can be secured 808 within the housing through use of heat stakes, snaps or various other mechanical members. Thereafter, an end piece can be attached 810 to the opening in the housing. Here, the end piece can serve to close the opening in the housing, thereby essentially sealing the opening in the housing. In doing so, exposed inner contact members of the end piece can respectively electrically connect with electrical connectors on the printed circuit board assembly. Hence, when the end piece is attached 810 to the opening, the inner contact members of the end piece can electrically coupled to the electrical connectors on the printed circuit board assembly. Consequently, electrical connection between the blades of the end piece can be made to the printed circuit board assembly by way of the inner contact members.

In general, the number, position, size and shape of blades (prongs) of a power adapter can vary depending on country or standard. In embodiments discussed herein the power adapters utilize two or three blades (prongs). If a third blade is provide, the third blade is typically provided as a ground or earthing member.

Figure 9A:
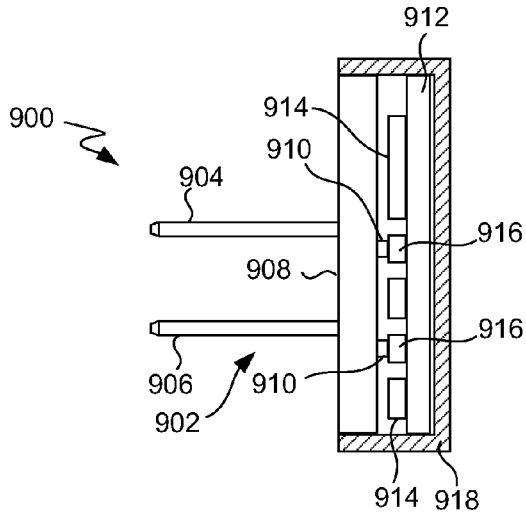
FIG. 9A is a side view of an electronic device assembly according to one embodiment of the invention.

FIG. 9A is a side view of an electronic device assembly 900 according to one embodiment of the invention. The electronic device assembly 900 is, for example, a power adapter, such as a power adapter that connects to an AC outlet and produces a DC output for powering an electronic device and/or charging a rechargeable battery of the electronic device.

The electronic device assembly 900 includes a power adapter end piece 902. The power adapter end piece 902 can, for example, be constructed similar to the power adapter plug 100 illustrated in FIGS. 1A-1C. The power adapter end piece 902 includes a first blade 904, a second blade 906, and a base 908. The base 908 supports the first blade 904 and the second blade 906. The base 908 also supports connection members 910 (or inner contact members). The electronic device assembly 900 also includes a printed circuit board 912. The power adapter end piece 902 can be mechanically and electrically connected to the printed circuit board 912. The printed circuit board 912 includes a plurality of electrical components 914 attached onto at least one side of the printed circuit board 912 to provide various electrical operations. The connection members 910 of the base 908 of the power adapter end piece 902 can be utilized to couple to corresponding connection devices 916 of the printed circuit board 912. Accordingly, in one embodiment, the connection members 910 of the power adapter end piece 902 can be mechanically and electrically connected to corresponding ones of the connection devices 916 of the printed circuit board 912. In one embodiment, the connection devices 916 are connectors that receive the connection members 910, thereby electrically connecting the first and second blades 904 and 906 of the power adapter end piece 902 with the printed circuit board 912.

In one embodiment, the power adapter end piece 902 is a low-profile power adapter cap which is able to couple directly to the printed circuit board 912 with little or no intervening by other components. As a result, the overall thickness of an electronic device (e.g., power adapter) being formed by the electronic device assembly 900 can be smaller and thinner. As shown in FIG. 9A, the base 908 of the power adapter end piece 902 is positioned adjacent the electrical components 914 mounted on the printed circuit board 912. However, in another embodiment, the base 908 of the power adapter end piece 900 can be positioned immediately adjacent the printed circuit board 912 (without any intervening electrical components 914).

As shown in FIG. 9A, the electronic device assembly 900 can be enclosed within an external device housing 918, thereby forming a power adapter product. The external device housing 918 is, for example, a compact enclosure that has an assembly opening at one side. The printed circuit board 912 can be placed within the external device housing 918 via the assembly opening. The printed circuit board 912 can, for example, be secured in the external device housing 918 by way of adhesive or mechanical members. The power adapter end piece 902 can then be placed in or over the assembly opening in the external device housing 918. In doing so, the connection members 910 of the base 908 are respectively aligned with and connect to the connection devices 916 of the printed circuit board 912. For example, the connection members 910 can be connector pins or posts, and the connection devices 916 can be connectors configured to receive the connector pins or posts when the power adapter end piece 902 is placed in or over the assembly opening in the external device housing 918. The power adapter end piece 902 can, for example, be secured in the external device housing 918 by way of adhesive, mechanical members and/or processing (e.g., ultrasonic welding).

In operation, the electronic device assembly 900, namely, power adapter product, can serve to convert AC power into DC power, and then supply the DC power to electrical components of an electronic device which can be electrically connected to the power adapter assembly 900 directly (e.g., integral with electronic device) or indirectly (e.g., by connector and/or wire (cord)). For example, the blades 904 and 906 of the electronic device assembly 900 can be inserted into an AC electrical outlet from which high-voltage Alternating Current (AC) can be acquired. The electrical components 914 associated with the printed circuit board 912 can operate to convert the high-voltage Alternating Current (AC) into a low-voltage Direct Current (DC) which is suitable for use for powering electrical components of the electronic device.

Although the electronic device assembly 900 illustrated in FIG. 9A includes a printed circuit board 912, in other embodiments, the printed circuit board 912 can be replaced with a different substrate. For example, the substrate can alternatively be a flexible substrate (e.g., flex-circuit).

Figure 9B:
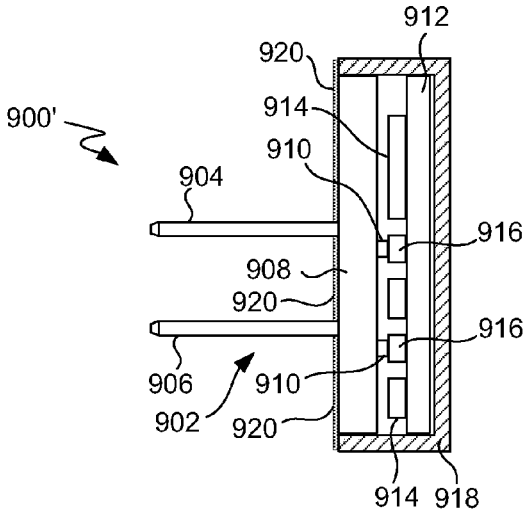
FIG. 9B is a side view of an electronic device assembly according to one embodiment of the invention.

FIG. 9B is a side view of an electronic device assembly 900' according to one embodiment of the invention. The electronic device assembly 900' is similar to the electronic device assembly 900 illustrated in FIG. 9A, except that the electronic device housing further includes a protective cover 920. The protective cover 920 serves to mitigate any damage to the base 908 due to electrical arcing or chemical leaching from the blades 904 and 906. In one implementation, the protective cover 920 is a label that is adhered to the base 908 by an adhesive. For example, the protective cover 920 can be a paper or plastic label with an adhesive backing. In one embodiment, the protective cover 920 covers the entire exposed surface of the base 908 and has openings for receiving the blades 904 and 906.

Figure 10:
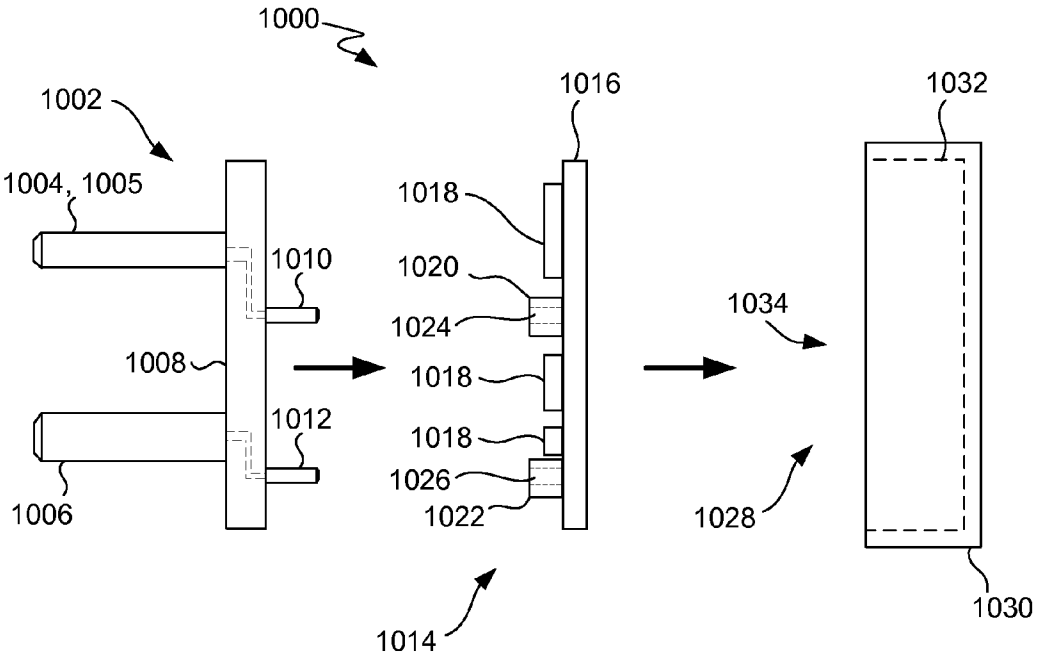
FIG. 10 is a side view of an assembly illustration for a power adapter according to one embodiment of the invention.

FIG. 10 is a side view of an assembly illustration for a power adapter 1000 according to one embodiment of the invention. As will be discussed below, the power adapter 1000 is assembled from an end piece, a printed circuit board assembly and a housing. The power adapter 1000 can be assembled in accordance with the power adapter assembly process 800 illustrated in FIG. 8.

An end piece 1002 can be formed. The end piece 1002 has first and second blades (plugs) 1004 and 1005, which can be inserted into an AC outlet. From the view in FIG. 10, the second blade 1005 is not visible as it is directly behind the first blade 1004. The end piece 1002 also has an additional blade 1006. A base 1008 supports the first and second blades 1004, 1005 and the additional blade 1006 on an output surface of the base 1008. The inner surface of the base 1008 includes a first connection member 1010 and a second connection member 1012. The first connection member 1010 is electrically connected to the first blade 1004, and the second connection member 1012 is electrically connected to the second blade 1005. As discussed above, the first and second connection members 1010 and 1012 are able to be moved or offset from the position of the first and second blades 1004 and 1005.

A printed circuit board assembly 1014 is also formed. The printed circuit board assembly 1014 includes a printed circuit board 1016 having a plurality of electrical components 1018 attached onto at least one side of the printed circuit board 1016 to provide various electrical operations. Also attached to the printed circuit board 1016 are a first connector 1020 and a second connector 1022. The first connector 1020 includes an opening 1024 (e.g., slot), and the second connector 1022 includes an opening 1026.

After the printed circuit board assembly 1014 has been formed, the printed circuit board assembly 1014 can be inserted into a housing 1028. The housing 1028 includes an outer surface 1030, which acts as an outer surface for much of the power adapter 1100. The printed circuit board assembly 1014 can be secured to an inner surface 1032 of the housing 1028. Thereafter, the end piece 1002 can be placed into the opening 1034 of the housing 1028. The end piece 1002 can also be secured to the opening 1034 and/or the housing 1028. When the end piece 1002 is placed within the opening 1034 of the housing 1028, the opening 1024 in the first connector 1020 receives the first connection member 1010, thereby providing an electrical connection between the first blade 1004 and the printed circuit board assembly 1014, and the opening 1026 in the second connector 1022 receives the second connection member, 1012 thereby providing an electrical connection between the second blade 1005 and the printed circuit board assembly 1014. The additional blade 1006 can be a guide or orientation member or may provide a ground (or earthed) connection. Hence, the additional blade 1006 may not need to connect with the printed circuit board assembly 1014.

In operation, the power adapter 1100 can serve to convert AC power into DC power, and then supply the DC power to electrical components of an electronic device which can be electrically connected to the power adapter 1100 directly (e.g., integral with electronic device) or indirectly (e.g., by connector and/or wire (cord)). For example, the blades 1004 and 1005 as well as the additional blade 1006 of the power adapter 1100 can be inserted into an AC electrical outlet from which high-voltage alternating current can be acquired. The electrical components 1018 associated with the printed circuit board 1016 can operate to convert the high-voltage Alternating Current (AC) into a low-voltage Direct Current (DC) which is suitable for use for powering electrical components of the electronic device.

Electrical plugs and their sockets differ by country in shape, size and type of connectors. The type used in each country is set by national standards legislation. The power adapters described herein are not limited to any particular type or configuration. Hence, as an example, the number, size and configuration of blades depicted and described in the various embodiments can vary.

FIGS. 11A-11E are diagrams illustrating a power adapter according to one embodiment of the invention. The power adapter illustrated in FIGS. 11A-11E use a particular plug used in Europe, for example.

Figure 11C:
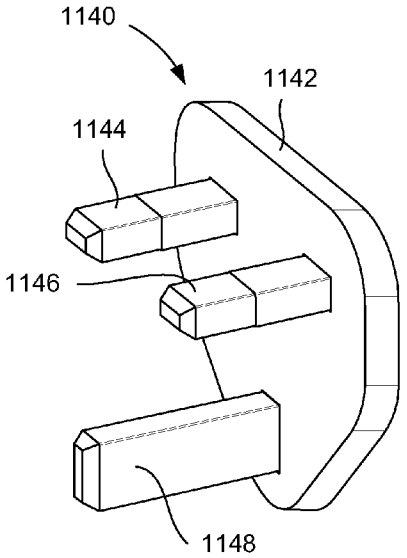
FIG. 11C is a perspective view of an end piece according to one embodiment of the invention.
Figure 11A:
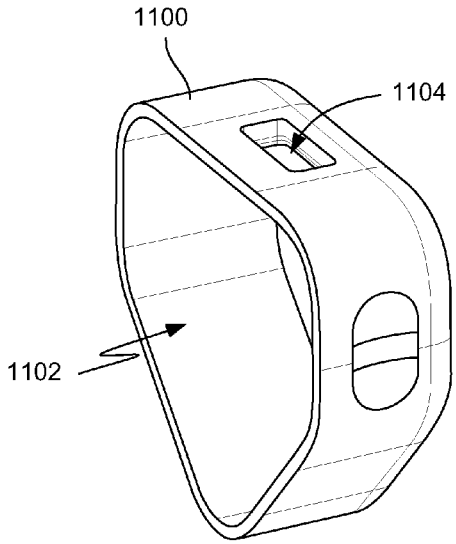
FIG. 11A is a perspective view of a housing for a power adapter according to one embodiment of the invention.

FIG. 11A is a perspective view of a housing 1100 for a power adapter according to one embodiment of the invention. The housing 1100 includes an opening 1102 for receiving electrical components as well as an end piece. In one embodiment, the housing 1100 can also include a connector opening 1104 to allow access to a peripheral connector provided within the power adapter 1100. For example, the peripheral connector can pertain to a Universal Serial Bus (USB) port.

Figure 11B:
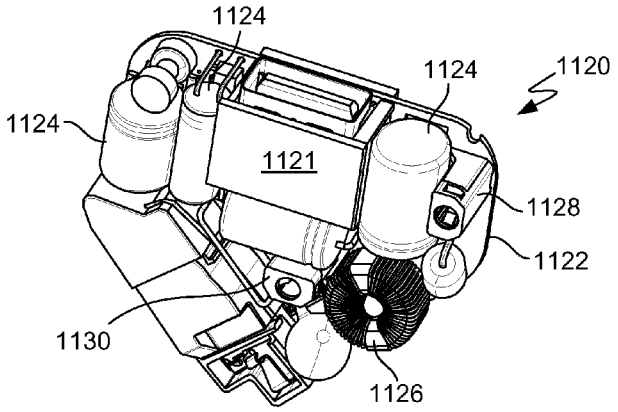
FIG. 11B is a perspective view of a printed circuit board assembly according to one embodiment of the invention.

FIG. 11B is a perspective view of a printed circuit board assembly 1120 according to one embodiment of the invention. The printed circuit board assembly 1120 is assembled and then inserted into the housing 1100. In the embodiment illustrated in FIG. 11B, the printed circuit board assembly 1120 includes a printed circuit board 1122. The printed circuit board 1122 can have electrical components mounted thereto. Examples of electrical components are capacitors, resistors, inductors, transistors, and integrated circuit chips. For example, the printed circuit board 1122 has resistors 1123, capacitors 1124, transistors, inductors 1126, and/or integrated circuit packages 1127 mounted thereto. Besides electrical components, the printed circuit board 1122 typically also includes metal (e.g., cooper, aluminum, solder) traces, solder connections, metal wires and/or metal leads. Still further, the printed circuit board assembly 1120 further includes a first connector 1128 and a second connector 1130. These connectors 1128 and 1130 are mounted on and electrically connect to the printed circuit board 1122. The printed circuit board 1122 can also have an electrical connector 1125, e.g., a peripheral bus connector, connected thereto. For example, the electrical connector 1125 can be a Universal Serial Bus (USB) connector. The electrical connector 1125 can be attached to the printed circuit board 1122. A bracket 1121 can be used to attach or support the electrical connector 1125 with respect to the printed circuit board 1122.

FIG. 11C is a perspective view of an end piece 1140 according to one embodiment of the invention. The end piece 1140 is formed and then inserted into the opening 1102 in the housing 1100 to close the opening and thereby encase the printed circuit board assembly 1120. Once the end piece 1140 is attached to the opening 1102 in the housing 1100, the opening 1102 is sealed (e.g., water-tight seal) The end piece 1140 includes a base portion 1142, a first blade 1144, a second blade 1146 and an additional blade 1148. In one embodiment, the additional blade member 1148 is electrically inactive. Although not shown, the back side of the base 1142 includes a first connection member that is electrically connected to the first blade 1144, and a second connection member that is electrically connected to the second blade 1146. The first connection member can electrically couple to one of the first blade 1144 and the second blade 1146, and the second connection member can electrically couple to the other of the first blade 1144 and the second blade 1146.

Figure 11D:
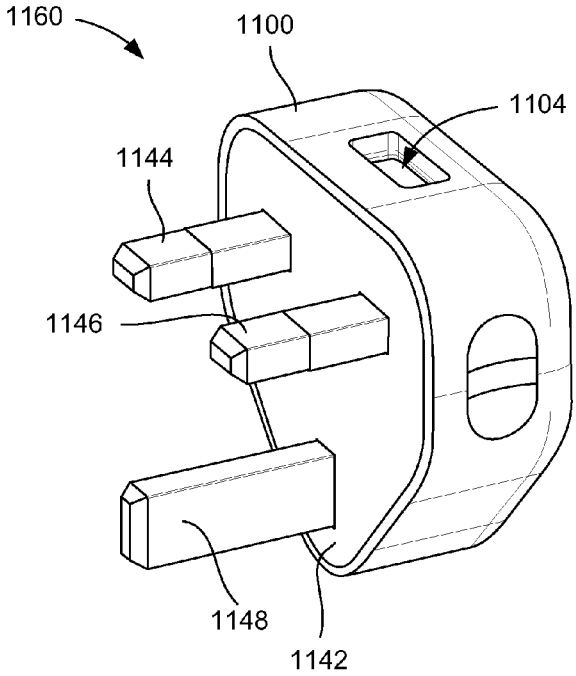
FIG. 11D is a perspective view of an assembled power adapter according to one embodiment of the invention.

FIG. 11D is a perspective view of an assembled power adapter 1160 according to one embodiment of the invention. The housing 1100 can have an opening 1104 for access to a peripheral connector. As shown in FIG. 11D, the end piece 1140 (see FIG. 11C) has been inserted into the opening 1102 of the housing 1100. The printed circuit board assembly 1120 is contained within the housing 1100, and the blades of 1144 and 1146 are electrically connected to the printed circuit board assembly 1120 as discussed above. The outer surface of the end piece 1142 serves as an inner surface for the housing 1100. The additional blade 1148 of the end piece 1140 is also provided. It should be noted that the end piece 1140 can be secured to the housing 1100 by a variety of different techniques. For example, the end piece 1140 can be glued to the housing 1100. As another example, the end piece 1140 can be ultrasonically welded to the housing 1100. In one embodiment, the end piece 1140 is secured to the housing 1100 such that a water-tight seal is provided.

Figure 11E:
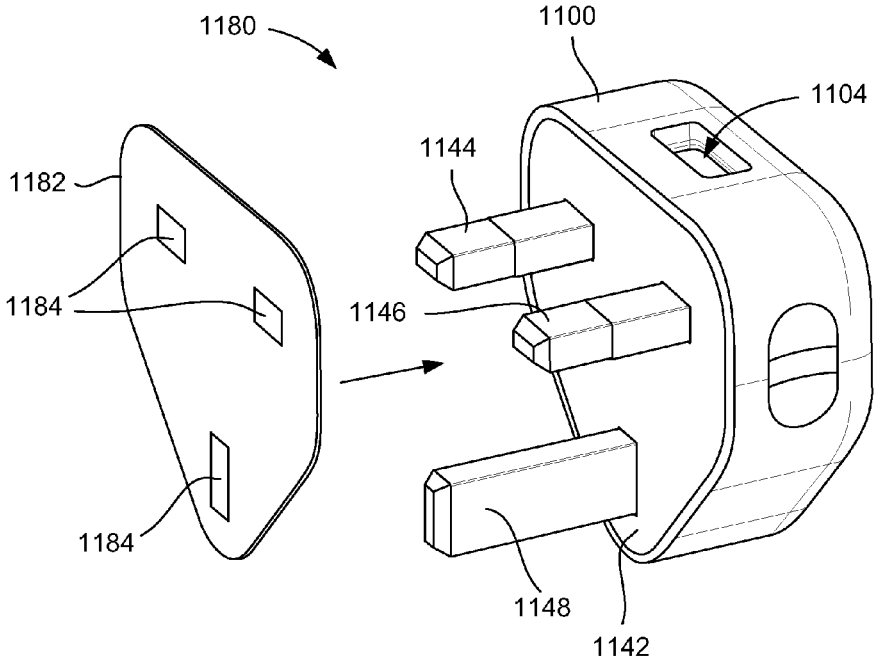
FIG. 11E is a perspective view of an assembled power adapter with a protective cover provided according to one embodiment of the invention.

FIG. 11E is a perspective view of an assembled power adapter 1180 with a protective cover provided according to one embodiment of the invention. The assembled power adapter 1180 includes the assembled power adapter 1160 illustrated in FIG. 11D with the addition of a protective cover 1182. The protective cover 1182 is provided on the exposed surface of the base 1142. The protective cover 1182 illustrated in FIG. 11E includes openings 1184 to correspond to the blades 1144 and 1146 as well as the additional blade 1148 of the end piece 1140. The protective cover 1182 can be adhered to the base 1142 through use of an adhesive. The protective cover 1182 can serve to mitigate any damage to the base 1142 due to electrical arcing or chemical leaching from the blades 1144 and 1146.

Figure 12:
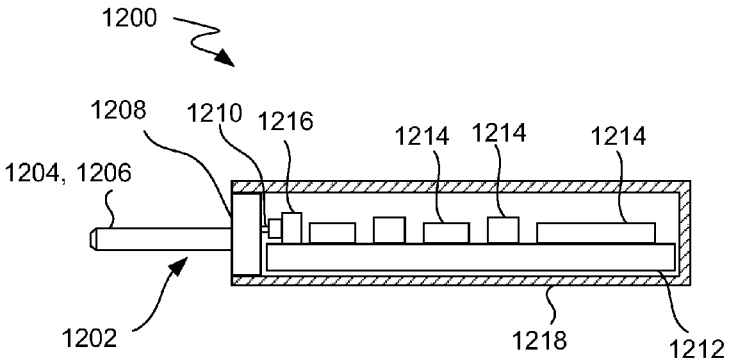
FIG. 12 is a side view of an electronic device assembly according to one embodiment of the invention.

FIG. 12 is a side view of an electronic device assembly 1200 according to one embodiment of the invention. The electronic device assembly 1200 is, for example, a power adapter, such as a power adapter that connects to an AC outlet and produces a DC output for powering an electronic device and/or charging a rechargeable battery of the electronic device.

The electronic device assembly 1200 includes a power adapter end piece 1202. The power adapter end piece 1202 can, for example, be constructed similar to the power adapter plug 100 illustrated in FIGS. 1A-1C. The power adapter end piece 1202 includes a first blade 1204, a second blade 1206, and a base 1208. The base 1208 supports the first blade 1204 and the second blade 1206. The base 1208 also supports connection members 1210 (or inner contact members). The electronic device assembly 1200 also includes a printed circuit board 1212. The power adapter end piece 1202 can be electrically connected (and possibly also mechanically connected) to the printed circuit board 1212. The printed circuit board 1212 includes a plurality of electrical components 1214 attached onto at least one side of the printed circuit board 1212 to provide various electrical operations. The connection members 1210 of the base 1208 of the power adapter end piece 1202 can be utilized to couple to corresponding connection devices 1216 mounted on the printed circuit board 1212. Accordingly, in one embodiment, the connection members 1210 of the power adapter end piece 1202 can be connected to corresponding ones of the connection devices 1216 of the printed circuit board 1212. In one embodiment, the connection devices 1216 are connectors that receive the connection members 1210, thereby electrically connecting the first and second blades 1204 and 1206 of the power adapter end piece 1202 with the printed circuit board 1212.

In one embodiment, the power adapter end piece 1202 is a low-profile power adapter cap which is able to couple adjacent an end of the printed circuit board 1212 with little or no intervening by other components. As a result, the overall length and thickness of an electronic device (e.g., power adapter) being formed by the electronic device assembly 1200 can be smaller and thinner. As shown in FIG. 12, the base 1208 of the power adapter end piece 1202 is positioned adjacent the edge of the printed circuit board 1212.

As shown in FIG. 12, the electronic device assembly 1200 can be enclosed within an external device housing 1218, thereby forming a power adapter product. The external device housing 1218 is, for example, a compact enclosure that has an assembly opening at one side. The printed circuit board 1212 can be placed within the external device housing 1218 via the assembly opening. The printed circuit board 1212 can, for example, be secured in the external device housing 1218 by way of adhesive or mechanical members. The power adapter end piece 1202 can then be placed in or over the assembly opening in the external device housing 1218. In doing so, the connection members 1210 of the base 1208 are respectively aligned with and connected to the corresponding connection devices 1216 of the printed circuit board 1212. For example, the connection members 1210 can be connector pins or posts, and the connection devices 1216 can be connectors configured to receive the connector pins or posts when the power adapter end piece 1202 is placed in or over the assembly opening in the external device housing 1218. The power adapter end piece 1202 can, for example, be secured in the external device housing 1218 by way of adhesive, mechanical members and/or processing (e.g., ultrasonic welding).

In operation, the electronic device assembly 1200, namely, power adapter product, can serve to convert AC power into DC power, and then supply the DC power to electrical components of an electronic device which can be electrically connected to the power adapter assembly 1200 directly (e.g., integral with electronic device) or indirectly (e.g., by connector and/or wire (cord)). For example, the blades 1204 and 1206 of the electronic device assembly 1200 can be inserted into an AC electrical outlet from which high-voltage Alternating Current (AC) can be acquired. The electrical components 1214 associated with the printed circuit board 1212 can operate to convert the high-voltage Alternating Current (AC) into a low-voltage Direct Current (DC) which is suitable for use for powering electrical components of the electronic device.

Although the electronic device assembly 1200 illustrated in FIG. 12 includes a printed circuit board 1212, in other embodiments, the printed circuit board 1212 can be replaced with a different substrate. For example, the substrate can alternatively be a flexible substrate (e.g., flex-circuit).

Figure 13A:
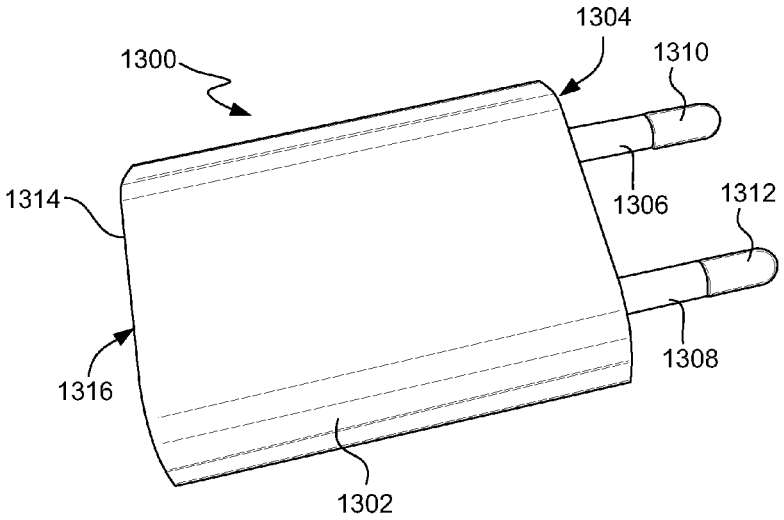
FIG. 13A illustrates a side perspective view of the electronic device according to one embodiment of the invention.
Figure 13B:
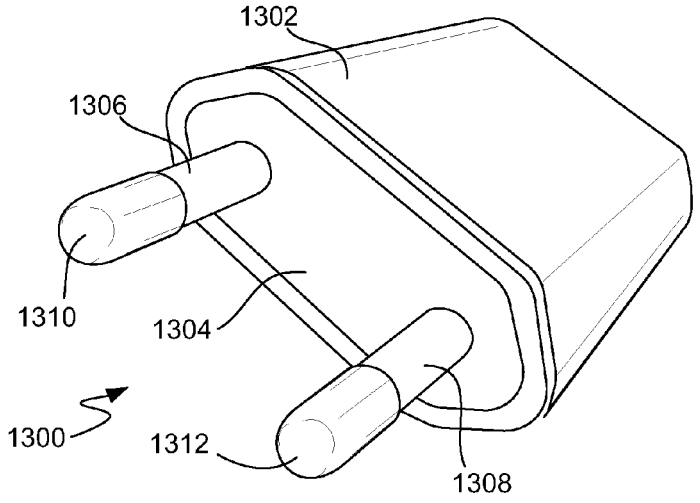
FIG. 13B illustrates a first end perspective view of the electronic device according to one embodiment of the invention.
Figure 13C:
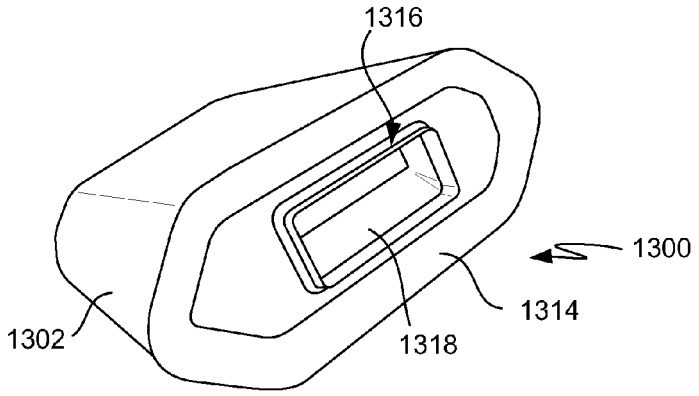
FIG. 13C illustrates a second end perspective view of the electronic device according to one embodiment of the invention.

FIGS. 13A-13C are perspective views of an electronic device 1300 according to one embodiment of the invention. The electronic device 1300 in this embodiment is a portable power adapter. The portable power adapter can be plugged into an electrical outlet. The portable power adapter can receive AC power from the electrical outlet and convert it into DC power. The DC power can then be made available to another electronic device that can couple to the portable power adapter.

FIG. 13A illustrates a side perspective view of the electronic device 1300 according to one embodiment of the invention. The electronic device 1300 includes a device housing 1302. As an example, the electronic device assembly 1200 illustrated in FIG. 12 can be implemented as the electronic device 1300. A first end of the device housing 1302 is configured to receive a cap 1304 (end cap or end piece). With the cap 1304 removed, an assembled electronic device (e.g., printed circuit board assembly) can be inserted into the device housing 1302. In FIG. 13A the cap 1304 is illustrated as being attached to the device housing 1302. The cap 1304 includes or supports a first plug 1306 and a second plug 1308. As illustrated, the plugs 1306 and 1308 are of a European configuration, however various other configurations are equally possible, including the U.S. configuration. The plugs 1306 and 1308 can be inserted into a power outlet (e.g., AC outlet). The plugs 1306 and 1308 can respectively include metal tips 1310 and 1312 which facilitate electrical connection when inserted into the power outlet. A second end 1314 includes an electrical connector 1316 that facilitates electrical connection with another device. When the electronic device 1300 is a portable power adapter, the electrical connector 1316 serves to provide power from the portable power adapter to another device that is electrically connected to the electrical connector 1316. As one example, the electrical connector 1316 can pertain to a USB connector.

FIG. 13B illustrates a first end perspective view of the electronic device 1300 according to one embodiment of the invention. The cap 1304 is illustrated attached to the device housing 1302. The plugs 1306 and 1308 of the cap 1304 are illustrated projecting outward from the cap 1304. The plugs 1306 and 1308 can have an exterior non-conductive shell (e.g., plastic) with an inner metal conductor that electrically connects the metal tips 1310 and 1312 to electronic component (e.g., printed circuit board assembly) within the device housing 1302.

FIG. 13C illustrates a second end perspective view of the electronic device 1300 according to one embodiment of the invention. The electrical connector 1316 is accessible from an opening 1318 in the second end 1314.

Figure 13D:
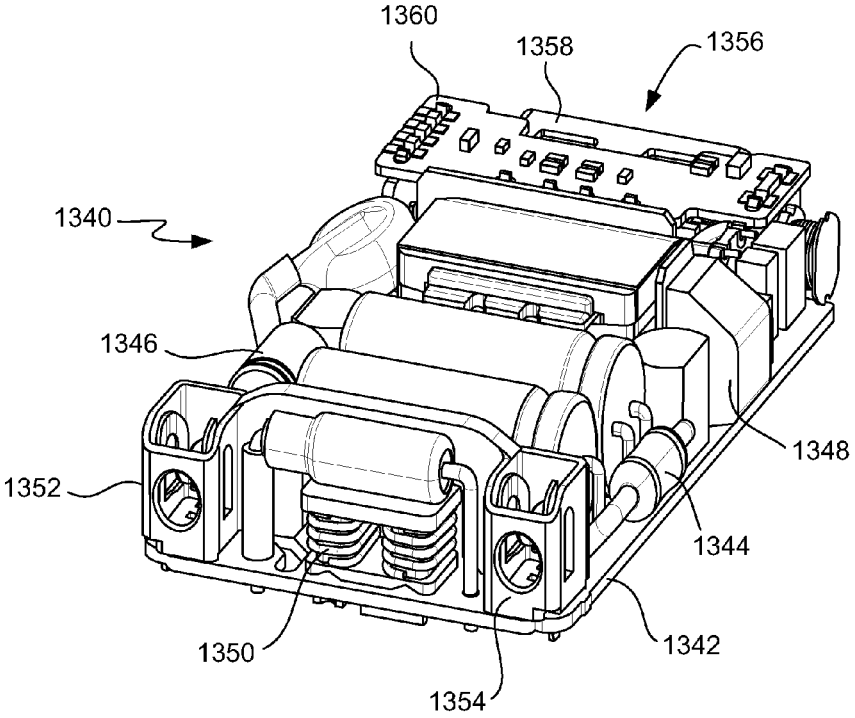
FIG. 13D is a perspective view of a printed circuit board assembly according to one embodiment of the invention.

FIG. 13D is a perspective view of a printed circuit board assembly 1340 according to one embodiment of the invention. The printed circuit board assembly 1340 is assembled and then inserted into the device housing 1302. In the embodiment illustrated in FIG. 13D, the printed circuit board assembly 1340 includes a printed circuit board 1342. The printed circuit board 1342 can have electrical components mounted thereto. Examples of electrical components are capacitors, resistors, inductors, transistors, and integrated circuit chips. For example, the printed circuit board 1342 has resistors 1344, capacitors 1346, transistors 1348, inductors 1350, and/or integrated circuit packages mounted thereto. Besides electrical components, the printed circuit board 1342 typically also includes metal (e.g., cooper, aluminum, solder) traces, solder connections, metal wires and/or metal leads. Still further, the printed circuit board assembly 1340 further includes a first connector 1352 and a second connector 1354. These connectors 1352 and 1354 are mounted on and electrically connect to the printed circuit board 1342. The printed circuit board 1342 can also have an electrical connector 1356, e.g., a peripheral bus connector, connected thereto at a side opposite the side having the connectors 1352 and 1354. For example, the electrical connector 1356 can be a Universal Serial Bus (USB) connector. The electrical connector 1356 can be attached to the printed circuit board 1342. A bracket 1358 can be used to attached or support the electrical connector 1356 with respect to the printed circuit board 1342. Additionally, in the embodiment shown in FIG. 13D, the printed circuit board assembly 1340 can also include a daughter printed circuit board 1360. For additional details on use of a daughter board or a multiple board and/or connectors see U.S. Provisional Patent Application No. 61/140,599, filed Dec. 23, 2008, entitled "COMPACT DEVICE HOUSING AND ASSEMBLY TECHNIQUES THEREFOR", which is hereby incorporated herein by reference.

Figure 13E:
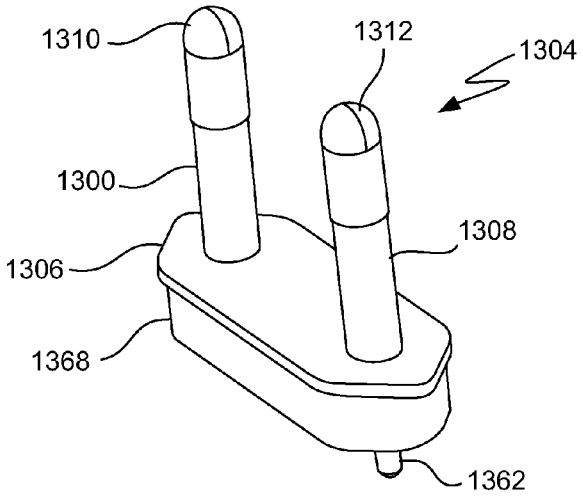
FIG. 13E a top perspective view of the cap according to one embodiment of the invention.
Figure 13F:
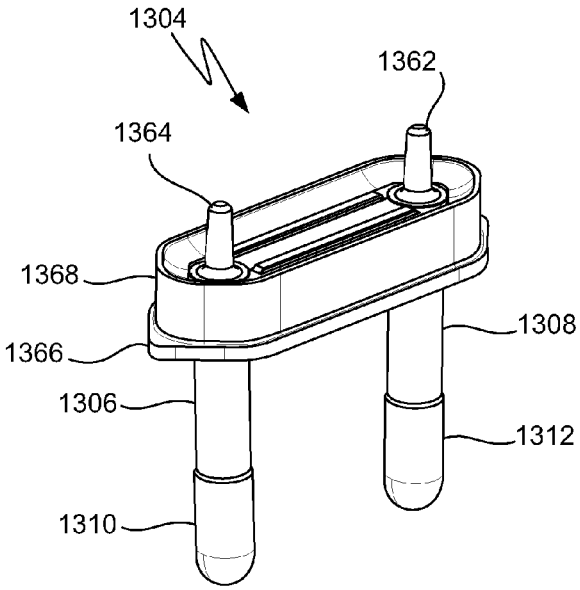
FIG. 13F a bottom perspective view of the cap according to one embodiment of the invention.

FIG. 13E is a top perspective view of the cap 1304 according to one embodiment of the invention, and FIG. 13F is a bottom perspective view of the cap 1304 according to one embodiment of the invention. The cap 1304 includes or supports the first plug 1306 and the second plug 1308. The plugs 1306 and 1308 can respectively include metal tips 1310 and 1312 which facilitate electrical connection when inserted into the power outlet. The cap 1304 also includes a top surface 1366 and a base portion 1368. The base portion 1368 is recessed in from the top surface 1366. When the cap 1304 is into an assembly opening of the device housing 1302, the base portion 1368 is provided inside the device housing 1302 and the top surface 1366 form the outer surface for the electronic device 1300 at the now closed assembly opening. Further, the inside surface of the base portion 1368 has inner connection members 1362 and 1364, such as a pins or posts. The inner connection member 1362 is coupled to or an extension of the plug 1306 (metal portion) and its associated metal tip 1310. The inner connection member 1364 is coupled to or an extension of the plug 1308 (metal portion) and its associated metal tip 1312. The connection members 1362 and 1364 are provided to couple to an electrical component (e.g., printed circuit board assembly) provided internal to the device housing 1302. Such connection occurs when the cap 1304 is attached to the assembly opening of the device housing 1302.

Additional details on power adapters and compact housings can be fount in (1) U.S. patent application Ser. No. 12/135,044, filed Dec. 6, 2008, entitled "LOW-PROFILE POWER ADAPTER", which is hereby incorporated herein by reference; and (2) U.S. Provisional Patent Application No. 61/140,599, filed Dec. 23, 2008, entitled "COMPACT DEVICE HOUSING AND ASSEMBLY TECHNIQUES THEREFOR", which is hereby incorporated herein by reference.

The various aspects, embodiments, implementations or features of the invention can be used separately or in any combination.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A power adapter, comprising:

a first metal prong having a front end and a back end;

a first metal base mechanically and electrically connected to the back end of the first metal prong, the first metal base including or coupling to at least a first connection member, and wherein, prior to mechanical and electrical connection of the first metal base and the first metal prong, the first metal base and the first metal prong are separate parts;

a second metal prong having a front end and a back end;

a second metal base mechanically and electrically connected to the back end of the second metal prong, the second metal base including or coupling to at least a second connection member, and wherein, prior to mechanical and electrical connection of the second metal base and the second metal prong, the second metal base and the second metal prong are separate parts;

a molded cap formed around the first and second metal bases such that the first and second metal prongs are at least partially exposed and the first and second metal bases are not exposed except for the first and second connection members which are at least partially exposed, the molded base being non-conductive;

a housing having a body with an opening configured to receive the molded cap; and a printed circuit board assembly having a plurality of electrical components coupled thereto, the printed circuit board assembly being provided within the housing, wherein when the molded cap is attached to the housing, the first metal prong is electrically connected to the printed circuit board assembly via the first connection member, and the second metal prong is electrically connected to the printed circuit board assembly via the second connection member.

2. A power adapter as recited in claim 1, wherein the housing is formed of molded plastic.

3. A power adapter as recited in claim 1, wherein the first and second metal prongs extend outward from a first side of the molded cap, and the first and second connection members extend outward from a second side of the molded cap.

4. A power adapter as recited in claim 3, wherein the second side is opposite the first side.

5. A power adapter as recited in claim 1, wherein the molded cap has a thickness of less than or equal to about three (3) millimeters.

6. A power adapter as recited in claim 1, wherein the power adapter comprises:

a first connector mounted on the printed circuit board assembly, the first connector being configured to receive the first connection member when the molded cap is attached to the housing, thereby electrically connecting the first connection member, and thus the first metal prong, to the printed circuit board assembly; and a second connector mounted on the printed circuit board assembly, the second connector being configured to receive the second connection member when the molded cap is attached to the housing, thereby electrically connecting the second connection member, and thus the second metal prong, to the printed circuit board assembly.

7. A power adapter as recited in claim 6, wherein the housing is formed of molded plastic.

8. A power adapter as recited in claim 6, wherein the first and second metal prongs extend outward from a first side of the molded cap, and the first and second connection members extend outward from a second side of the molded cap.

9. A power adapter as recited in claim 8, wherein the second side is opposite the first side.

10. A power adapter as recited in claim 6, wherein the molded cap has a thickness of less than or equal to about three (3) millimeters.

11. A portable power adapter as recited in claim 1, wherein the front end of the first metal prong includes an attachable tip that is configured to be attachable to the front end, and wherein the front end of the second metal prong includes an attachable tip that is configured to be attachable to the front end.

12. A power adapter as recited in claim 11, wherein the first and second metal prongs extend outward from a first side of the molded cap, and the first and second connection members extend outward from a second side of the molded cap, the second side being opposite the first side, and wherein the first and second connection members are positionally offset from the first and second metal prongs.

13. A power adapter as recited in claim 11, wherein the molded cap has a thickness of less than or equal to about three (3) millimeters.

14. A portable power adapter as recited in claim 1, wherein the front end of the first metal prong includes at least an attachment feature, and wherein the front end of the first metal prong includes an attachable tip that is configured to be attachable to the attachment feature at the front end.

15. A portable power adapter as recited in claim 14, wherein the front end of the second metal prong includes at least an attachment feature, and wherein the front end of the second metal prong includes an attachable tip that is configured to be attachable to the attachment feature at the front end.

16. A power adapter as recited in claim 1, wherein the first and second metal prongs extend outward from a first side of the molded cap, and the first and second connection members extend outward from a second side of the molded cap, the second side being opposite the first side, and wherein the first and second connection members are positionally offset from the first and second metal prongs.

17. A power adapter as recited in claim 16, wherein the molded cap has a thickness of less than or equal to about three (3) millimeters.

18. A power adapter, comprising:

a first metal prong having a front end and a back end;

a first metal base mechanically and electrically connected to the back end of the first metal prong, the first metal base including or coupling to at least a first connection member, and wherein, prior to mechanical and electrical connection of the first metal base and the first metal prong, the first metal base and the first metal prong are separate parts;

a second metal prong having a front end and a back end;

a second metal base mechanically and electrically connected to the back end of the second metal prong, the second metal base including or coupling to at least a second connection member, and wherein, prior to mechanical and electrical connection of the second metal base and the second metal prong, the second metal base and the second metal prong are separate parts;

a housing having an internal region; and a printed circuit board assembly having a plurality of electrical components coupled thereto, the printed circuit board assembly being provided within the internal region of the housing, wherein the first metal prong is electrically connected to the printed circuit board assembly via the first connection member, and the second metal prong is electrically connected to the printed circuit board assembly via the second connection member, wherein the housing includes a first part and a second part, and wherein the first part of the housing includes a molded structure formed around the first and second metal bases such that the first and second metal prongs are at least partially exposed from the exterior of the housing and the first and second connection members are at least partially exposed within the interior of the housing, the molded structure being non-conductive.

19. A power adapter as recited in claim 18, wherein at least the first part of the housing is formed of molded plastic.

20. A power adapter as recited in claim 18, wherein the first and second connection members are positionally offset from the first and second metal prongs.

21. A power adapter as recited in claim 18, wherein the power adapter comprises:

a first connection region provided on the printed circuit board assembly, the first connection region being configured to couple with the first connection member, thereby electrically connecting the first connection member, and thus the first metal prong, to the printed circuit board assembly; and a second connection region provided on the printed circuit board assembly, the second connection region being configured to couple with the second connection member, thereby electrically connecting the second connection member, and thus the second metal prong, to the printed circuit board assembly.

22. A power adapter as recited in claim 21, wherein the first and second metal prongs extend outward from an exterior surface of the housing, and the first and second connection members extend inward within the internal region of the housing, and wherein the first and second connection members extend in opposite directions and are positionally offset from the first and second metal prongs.

23. A power adapter as recited in claim 21, wherein the first connection region includes a first connector for coupling with the first connection member, and wherein the second connection region includes a second connector for coupling with the second connection member.

24. A power adapter as recited in claim 20, wherein at least a portion of the housing is formed of molded plastic.

25. A portable power adapter as recited in claim 18, wherein the front end of the first metal prong includes an attachable tip that is configured to be attachable to the front end, and wherein the front end of the second metal prong includes an attachable tip that is configured to be attachable to the front end.

26. A power adapter as recited in claim 18, wherein the first and second connection members are positionally offset from the first and second metal prongs.

27. A portable power adapter as recited in claim 18, wherein the front end of the first metal prong includes at least an attachment feature, and wherein the front end of the first metal prong includes an attachable tip that is configured to be attachable to the attachment feature at the front end.

28. A portable power adapter as recited in claim 27, wherein the front end of the second metal prong includes at least an attachment feature, and wherein the front end of the second metal prong includes an attachable tip that is configured to be attachable to the attachment feature at the front end.

29. A power adapter as recited in claim 18, wherein the first and second metal prongs extend outward from an exterior surface of the housing, and the first and second connection members extend inward within the internal region of the housing, and wherein the first and second connection members extend in opposite directions and are positionally offset from the first and second metal prongs.

30. A power adapter as recited in claim 18, wherein the first metal prong has a front end and a back end, with the back end having at least one attachment feature, wherein the first metal base has at least one opening to receive the at least one attachment feature of the first metal prong, and wherein the first metal prong is secured proximate to the at least one opening of the first metal base using the at least one attachment feature, thereby providing a mechanical and electrical connection between the first metal prong and the first metal base.

31. A power adapter as recited in claim 30, wherein the second metal prong has a front end and a back end, with the back end having at least one attachment feature, wherein the second metal base has at least one opening to receive the at least one attachment feature of the second metal prong, and wherein the second metal prong is secured proximate to the at least one opening of the second metal base using the at least one attachment feature, thereby providing a mechanical and electrical connection between the second metal prong and the second metal base.

32. A power adapter as recited in claim 31, wherein the first and second metal prongs extend outward from an exterior surface of the housing, and the first and second connection members extend inward within the internal region of the housing, and wherein the first and second connection members extend in opposite directions and are positionally offset from the first and second metal prongs.

33. A power adapter as recited in claim 31, wherein the power adapter comprises:

a first connection region provided on the printed circuit board assembly, the first connection region being configured to couple with the first connection member, thereby electrically connecting the first connection member, and thus the first metal prong, to the printed circuit board assembly; and a second connection region provided on the printed circuit board assembly, the second connection region being configured to couple with the second connection member, thereby electrically connecting the second connection member, and thus the second metal prong, to the printed circuit board assembly.

* * * * *